US006819899B2

(12) United States Patent
Miyakawa et al.

(10) Patent No.: US 6,819,899 B2
(45) Date of Patent: Nov. 16, 2004

(54) IMAGE FORMING APPARATUS EMPLOYING WORK FUNCTION RELATIONSHIPS

(75) Inventors: Nobuhiro Miyakawa, Nagano-Ken (JP); Shinji Yasukawa, Nagano-Ken (JP); Nobumasa Abe, Nagano-Ken (JP); Mikio Furumizu, Nagano-Ken (JP); Kaneo Yoda, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 98 days.

(21) Appl. No.: 10/177,756

(22) Filed: Jun. 24, 2002

(65) Prior Publication Data

US 2003/0095814 A1 May 22, 2003

(30) Foreign Application Priority Data

Jun. 22, 2001 (JP) ..... 2001-189339
Jul. 27, 2001 (JP) ..... 2001-227911

(51) Int. Cl.[7] ..... G03G 15/08
(52) U.S. Cl. ..... 399/252; 399/281
(58) Field of Search ..... 399/159, 176, 399/252, 281, 284

(56) References Cited

U.S. PATENT DOCUMENTS 5,367,367 A * 11/1994 Ikeda et al. ..... 399/281
5,384,625 A * 1/1995 Anayama et al. ..... 399/159
5,500,718 A * 3/1996 Hashimoto et al. ..... 399/51 X
5,602,712 A * 2/1997 Daifuku et al. ..... 399/176 X
5,761,589 A * 6/1998 Kido et al. ..... 399/284
5,875,375 A * 2/1999 Ohmori et al. ..... 399/159
6,104,903 A 8/2000 Hara et al.
6,343,201 B1 * 1/2002 Wada et al. ..... 399/281

FOREIGN PATENT DOCUMENTS

| | | | |
|---|---|---|---|
| EP | 0 608 562 A1 | | 8/1994 |
| JP | 3-62072 | | 3/1991 |
| JP | 3-233477 | | 10/1991 |
| JP | 10-010870 | * | 1/1998 |

OTHER PUBLICATIONS

Japanese Abstract of JP A 03062072, Mar. 18, 1991, Toshiba Corporation.
Japanese Abstract of JP A 06332236, Dec. 2, 1994, Konica Corporation (XP–002215631).
Japanese Abstract of JP A 04029158, Jan. 31, 1992, Fujitsu Ltd. (XP–002215632).

* cited by examiner

*Primary Examiner*—Fred Braun
(74) *Attorney, Agent, or Firm*—Sughrue Mion, PLLC

(57) ABSTRACT

An image forming apparatus including a latent image carrier and a developing device for charging a toner into a negative polarity by triboelectric charging, wherein the work function of the toner is set to be larger than the work function of the surface of the latent image carrier. When the apparatus includes an intermediate transfer medium, the work function of the toner is set to be larger than the work function of the surface of the intermediate transfer medium. In another embodiment, the work function $\Phi_{opc}$ of the surface of the latent image carrier, the work function $\Phi_t$ of the toner, and the work function $\Phi_{TM}$ of the surface of the intermediate transfer medium are set to satisfy a relationship $\Phi_t > \Phi_{OPC} > \Phi_{TM}$. These relationships help to reduce fog, and improve transfer efficiency which reduces the consumption of the toner.

24 Claims, 7 Drawing Sheets

IMAGE FORMING APPARATUS EMPLOYING WORK FUNCTION RELATIONSHIPS

BACKGROUND OF THE INVENTION

The present invention relates to an image forming apparatus employing electrophotographic technology and particularly to an image forming apparatus which transfers a visible toner image formed on a latent image carrier to a recording medium electrostatially.

In a conventional image forming apparatus, a photoreceptor as a latent image carrier such as a photosensitive drum or a photosensitive belt is rotatably supported to the main body of the image forming apparatus. During the image forming operation, a latent image is formed onto a photosensitive layer of the photoreceptor and, after that, is developed with toner particles to form a visible image. Then, the visible image is transferred to a recording medium. For transferring the visible image, there are a method of directly transferring the visible image to the recording medium by using a corona discharge or a transferring roller, and a method of transferring the visible image to the recording medium via an intermediate transfer member such as a transfer drum or a transfer belt, that is, transferring the visible image twice.

These methods are employed in monochrome image forming apparatuses. In addition, for a color image forming apparatus having a plurality of photoreceptors and developers, there is a known method transferring a plurality of color images on a transfer belt or transfer drums to a recording medium such as a paper in such a manner that the respective color images are sequentially superposed on each other, and then fixing these images. The apparatuses according to such a method using a belt are categorized as a tandem type while the apparatuses according to such a method using drums are categorized as a transfer drum type. Moreover, an intermediate transferring type is also known in which color images are sequentially primary-transferred to an intermediate transfer medium and the primary-transferred images are secondary-transferred to a recording medium such as a paper at once. Arranged on the photoreceptor used for any of the aforementioned methods is a cleaning mechanism for cleaning toner particles after developing and residual toner particles remaining on the photoreceptor after the transferring.

As toner used for such an image forming apparatus, dual-component toner composed of a developer and a magnetic carrier is generally known. Though the dual-component toner achieves relatively stable developing, the mixing ratio of the developer and the magnetic carrier is easily varied so that the maintenance for the mixing ratio is required. Accordingly, magnetic single-component toner has been developed. However the magnetic single-component toner has such a problem that clear color images are not obtained due to the opacity of magnetic material thereof. On the other hand, non-magnetic single-component toner has been developed as color toner. For obtaining high-quality record images with the non-magnetic single-component toner, there is a problem how to uniformly charge the toner particles In order to solve the aforementioned problem of the non-magnetic single-component toner, Japanese Patent Unexamined publication H3-62072 discloses a toner layer thickness regulating member for a developing device. The toner layer thickness regulating member is made of a metal of which work function is low so as to have not only a function controlling the thickness of a toner layer but also a function actively causing triboelectric charging, thereby making charge uniform. This avoid local variation in the developing concentration due to insufficient charge, prevents deterioration of quality of record images, and equalize the thickness of toner layer. As a similar technique, Japanese Patent Unexamined Publication H3-23347 discloses a developer carrying member (development roller), a developer controlling means, and a developer which are set to satisfy a relation $(Wd-Wt)\times(Wb-Wt)>0$, wherein Wd, Wb, and Wt are respective work functions of the developer carrying member, the developer controlling means, and the developer, thereby reducing inversely-charged toner particles and low-charged toner particles. Even when the relation of the work functions of the aforementioned three components is satisfied as disclosed in the publication, there are problems that a phenomenon called "fog", in which non-image portions are developed, may still occur because toner particles have a particle size distribution and that it is impossible to increase the transfer efficiency.

As for color image apparatuses, the modern trend is toward the use of toner of small particle size, uniform, and high circularity in order to improve the transfer efficiency. However, the use of such a toner reduces the fluidity of toner due to the small particle size so that it is hard to cause triboelectric charging relative to a development roller or a toner layer thickness regulating member. As a result, it is impossible to give sufficient charge. In case of toner for negative charge, there is a problem that some toner particles may be positively charged due to inductive charge.

Particularly, in an image forming apparatus which forms images by negative charge reversal developing, there is a problem of the toner and a photoreceptor that positively charged toner particles on non-image portions of a latent image carrier (photoreceptor) make "fog", thus increasing the actual consumption of toner and also increasing the cleaning load of the photoreceptor. If a large amount of superplasticizing agent is added as an external additive to the toner in order to resolve the aforementioned problem, there may be another problem of reducing the fixing property. In a color image forming apparatus using an intermediate transfer medium, there is a problem that positively charged toner particles on a photoreceptor, if any, reduce the transfer efficiency to the intermediate transfer medium.

It is a first object of the present invention to provide an image forming apparatus of a type developing a latent image on a latent image carrier (photoreceptor) with negatively charged toner particles, in which there is little fog on non-image portions of the photoreceptor during developing and it is possible to improve the transfer efficiency.

It is a second object of the present invention to provide an image forming apparatus employing a developing device of a type developing a latent image on a latent image carrier with negatively charged toner particles, in which in a process of transferring a visible image developed on the latent image carrier to an intermediate transfer medium, the charge of positively charged toner particles adhering to the latent image carrier is reduced, thereby increasing the transfer efficiency to the intermediate transfer medium.

It is a third object of the present invention to provide an image forming apparatus which can minimize the consumption of toner particles so as to reduce the amount of toner particles to be cleaned, thereby reducing the running cost and reducing the size of a cleaning container.

SUMMARY OF THE INVENTION

An image forming apparatus of the present invention comprises: a latent image carrier; and a developing means for charging a toner into a negative polarity by triboelectric charging, for converting an electrostatic latent image on said latent image carrier to a visible image with said toner, and is characterized in that the work function ($\Phi_t$) of said toner is set to be larger than the work function ($\Phi_{OPC}$) of the surface of said latent image carrier.

The image forming apparatus is characterized in that the work function ($\Phi_t$) of the toner is in a range from 5.4 to 5.9 eV, the work function ($\Phi_{OPC}$) of the surface of the latent image carrier is in a range from 5.2 to 5.6 eV, and the difference between the work function ($\Phi_t$) of the toner and the work function ($\Phi_{OPC}$) of the surface of the latent image carrier is at least 0.2 eV or more.

An image forming apparatus of the present invention comprises: a latent image carrier; and a developing means for charging a toner into a negative polarity by triboelectric charging, for converting an electrostatic latent image on said latent image carrier to a visible image with said toner and transferring said visible image to an intermediate transfer medium, and is characterized in that the work function ($\Phi_t$) of said toner is set to be larger than the work function ($\Phi_{TM}$) of the surface of said intermediate transfer medium.

The image forming apparatus is characterized in that the work function ($\Phi_t$) of the toner is in a range from 5.4 to 5.9 eV, the work function ($\Phi_{TM}$) of the surface of the intermediate transfer medium is in a range from 4.9 to 5.5 eV, and the difference between the work function ($\Phi_t$) of said toner and the work function ($\Phi_{TM}$) of the surface of the intermediate transfer medium is at least 0.2 eV or more.

An image forming apparatus of the present invention comprises: a latent image carrier; and a developing means for charging a toner into a negative polarity by triboelectric charging, for converting an electrostatic latent image on said latent image carrier to a visible image with said toner and transferring said visible image to an intermediate transfer medium, and is characterized in that the work function ($\Phi_{OPC}$) of the surface of said latent image carrier, the work function ($\Phi_t$) of said toner, and the work function ($\Phi_{TM}$) of the surface of said intermediate transfer medium are set to satisfy a relation $\Phi_t > \Phi_{OPC} > \Phi_{TM}$.

The image forming apparatus is characterized in that the work function ($\Phi_t$) of the toner is in a range of 5.4 to 5.9 eV, the work function ($\Phi_{OPC}$) of the surface of the latent image carrier is in a range of 5.2 to 5.6 eV, and the work function ($\Phi_{TM}$) of the surface of the intermediate transfer medium is in a range of 4.9 to 5.5 eV, and the difference between each pair of them is at least 0.2 eV or more.

In the image forming apparatus of the present invention, the number mean particle diameter is from 4 to 10 $\mu$m.

In the image forming apparatus of the present invention, the degree of circularity is 0.91 or more.

In the image forming apparatus of the present invention, the latent image carrier is an organic photoreceptor to be negatively charged so as to carry out the reversal developing.

In the image forming apparatus of the present invention, the latent image carrier and the developing means are rotatably supported to a body of the image forming apparatus such that the latent image carrier and said developing means are in contact with each other, and wherein the peripheral velocity of said developing means is set to be 1.2 to 2.5 times as high as the peripheral velocity of said latent image carrier.

In the image forming apparatus of the present invention, the latent image carrier and the developing means are rotatably supported to a body of the image forming apparatus such that said latent image carrier and said developing means are in non-contact with each other, and wherein the pressing load of the intermediate transfer medium against said latent image carrier is set in a range from 20 gf/cm to 60 gf/cm.

In the image forming apparatus of the present invention, the developing means comprises a development roller and a toner layer regulating member to regulate such that the number of layers made up of toner particles becomes 1.2 to 3.

The image forming apparatus of the present invention is a full-color image forming apparatus.

In the image forming apparatus of the present invention, the latent image carrier and the developing means are unified in a process cartridge to be detachably installed in the image forming apparatus.

In the image forming apparatus of the present invention, the peripheral velocity of the intermediate transfer medium is set to be 0.95 to 1.05 times as high as the peripheral velocity of the latent image carrier.

In the image forming apparatus of the present invention, the intermediate transfer medium is of a belt type.

In an image forming apparatus for developing a latent image on a latent image carrier with a negatively charged toner, the present invention can reduce the amount of fog on non-image portion with toner particles on the photoreceptor during development and can improve the transfer efficiency. According to the present invention, positively charged toner particles adhering to the latent image carrier can be converted into negatively charged toner particles because of the contact with the intermediate transfer medium, thereby improving the transfer efficiency from the latent image carrier to the intermediate transfer medium. According to the present invention, since toner particles can be converted into negatively charged toner particles at contact between the toner and the latent image carrier and at contact between the toner on the latent image carrier and the image transfer medium, negative charging can be conducted even when negative charging is insufficient, thereby further improving the transfer efficiency.

Since the amount of fog toner on non-image portions with toner particles on the photoreceptor during development can be reduced and the transfer efficiency can be improved, thereby reducing the consumption of the toner. Since the cleaning toner amount is reduced, reduction in running cost and reduction in size of the cleaning toner container can be achieved.

BRIEF DESCRIPTION OF THE DRAWINGS

FIG. 6 is a diagram showing a charge distribution characteristic of toner particles used in the image forming apparatus of the present invention;

DESCRIPTION OF THE PREFERRED EMBODIMENTS

Figure 1:
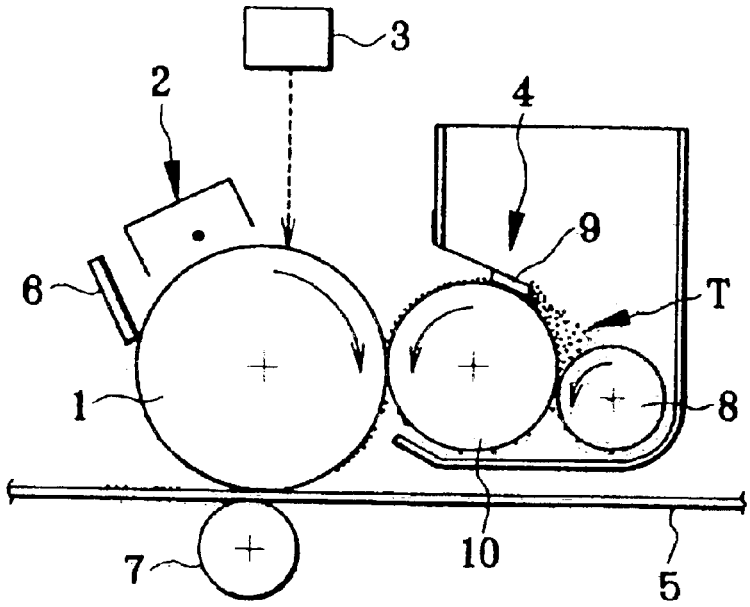
FIG. 1 is an explanatory illustration showing an example of the image forming apparatus of a contact developing type according to the present invention.
Figure 2:
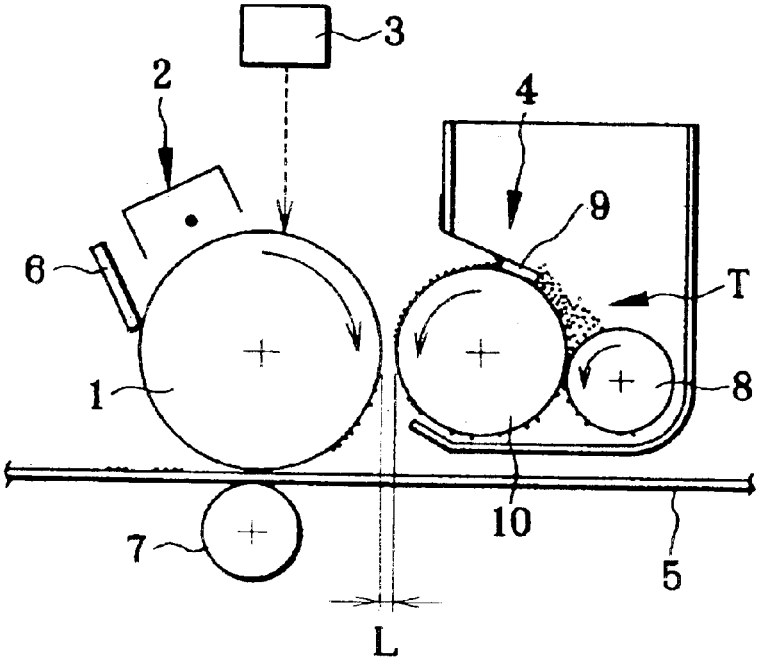
FIG. 2 is an explanatory illustration showing an example of the image forming apparatus of a non-contact developing type according to the present invention.

FIG. 1 shows an example of the image forming apparatus of a contact developing type according to the present invention and FIG. 2 shows an example of the image forming apparatus of a non-contact developing type according to the present invention. In FIG. 1 and FIG. 2, arranged around a latent image carrier (organic photoreceptor) 1 are a charging means 2, an exposing means 3, a developing means 4, an intermediate transfer medium 5, and a cleaning means 6. Numeral 7 designates a backup roller, 8 designates a toner supplying roller, 9 designates a toner regulating blade (toner layer thickness regulating member), 10 designates a development roller, a mark T designates a non-magnetic single-component toner. In FIG. 2, a mark L designates a developing gap.

In the image forming apparatus of the present invention, the toner, the latent image carrier, and the intermediate transfer medium are evaluated according to their work functions measured by the following measuring method. The work function (Φ) is known as minimum energy necessary for taking out one electron from the substance. The smaller the work function of a substance is, it is easier to take out electrons from the substance. The larger the work function of a substance is, it is harder to take out electrons from the substance. Accordingly, when a substance having a small work function and a substance having a great work function are in contact with each other, the substance having a small work function is positively charged and the substance having a great work function is negatively charged. Work function can be measured by a method as described below and can be numerically indicated as energy (eV) necessary for taking out one electron from the substance. Based on work functions, charging property by contacts between toner consisting of various substances and respective members of the image forming apparatus can be evaluated.

Work function (Φ) is measured by the use of a surface analyzer (Low energy electron spectrometer AC-2, produced by Riken Keisokuki Co., Ltd). According to the present invention, in the analyzer in which a heavy hydrogen lump is used, the radiation amount for the development roller plated with metal is set to 10 nW, the radiation amount for other members is set to 500 nW, and a monochromatic beam is selected by a spectrograph, samples are radiated with a spot size of 4 square mm, an energy scanning range of 3.4–6.2 eV, and a measuring time of 10 sec/one point. The quantity of photoelectrons emitted from each sample surface is detected. Work function is calculated by using a work function calculating software based on the quantity of photoelectron and measured with repeatability (standard deviation) of 0.02 eV. For ensuring the repeatability of data, the samples to be measured are left for 24 hours at environmental temperature and humidity of 25° C., 55%RH before measurement.

Figure 7A:
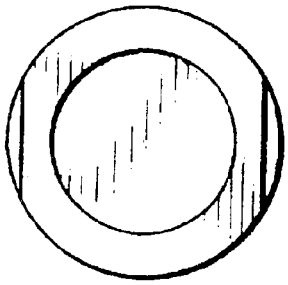
FIGS. 7(*a*), 7(*b*) are illustrations showing a measuring cell used for measuring the work function of the toner, wherein FIG. 7(*a*) is a front view thereof and FIG. 7(*b*) is a side view thereof.
Figure 7B:
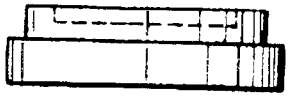
Figure 8A:
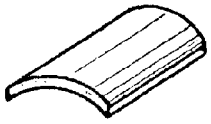
Figure 8B:
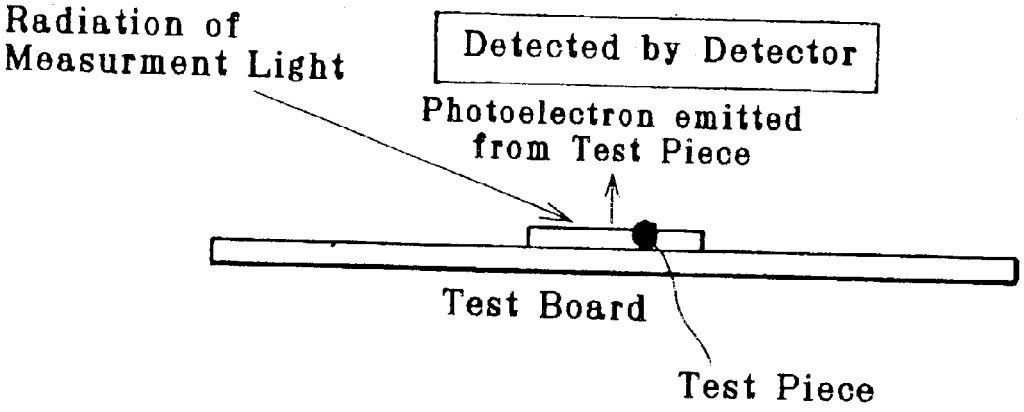

A measurement cell for sample toners is a stainless steel disk which is 13 mm in diameter and 5 mm in height and is provided at the center thereof with a toner receiving concavity which is 10 mm in diameter and 1 mm in depth as shown in FIGS. 7(*a*), 7(*b*). For measurement, toner is entered in the concavity of the cell by using a weighting spoon without pressure and then is leveled by using a knife edge. The measurement cell filled with the toner is fixed to a test board at a predetermined position. Then, measurement is conducted under conditions that the radiation amount is set to 500 nW, and the spot size is set to 4 square mm, the energy scanning range is set to 4.2–6.2 eV in the same manner as described later with reference to FIG. 8(*b*).

Figure 8:
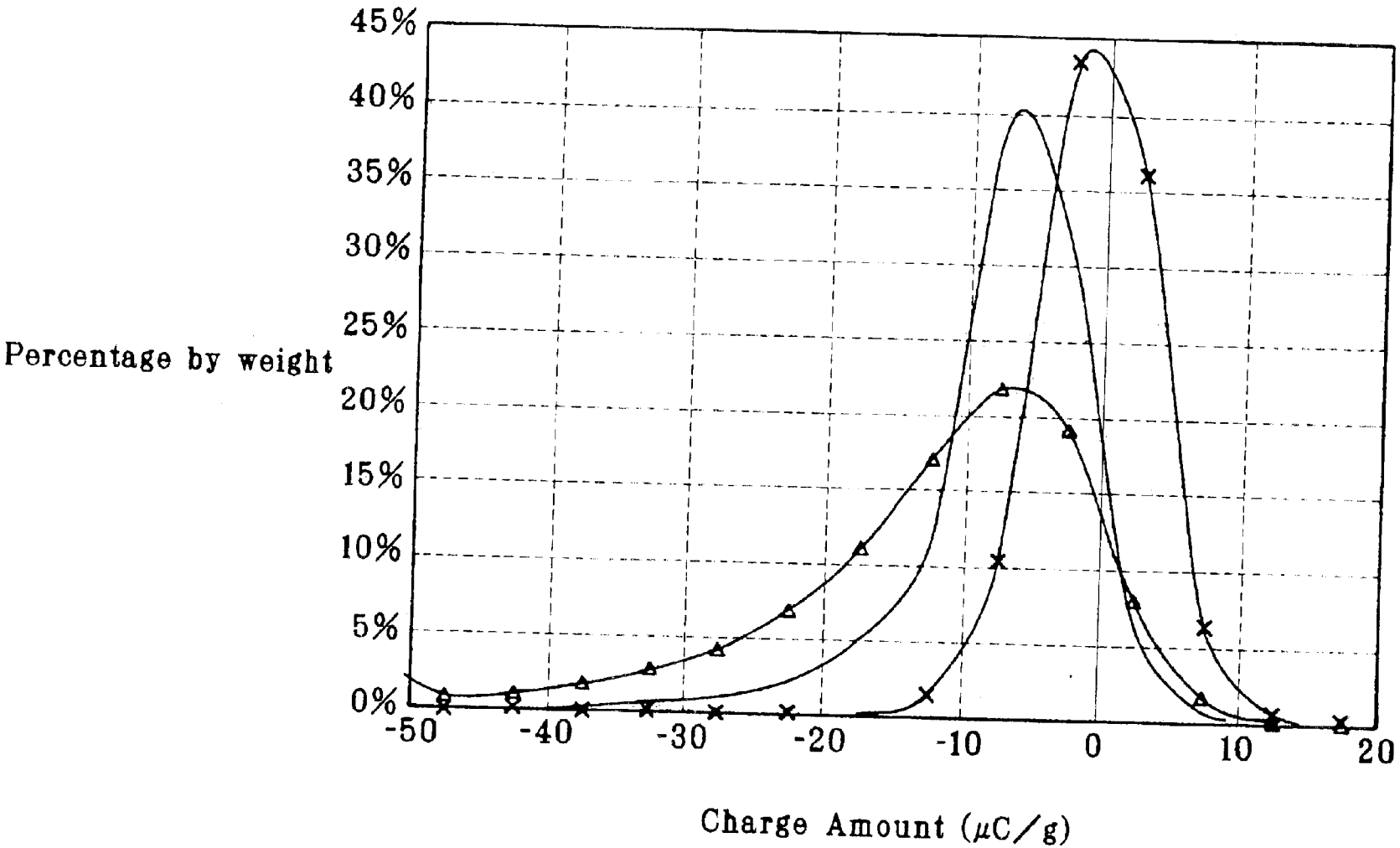
FIGS. 8(*a*), 8(*b*) are illustrations for explaining the method of measuring the work function of a cylindrical member of the image forming apparatus, wherein FIG. 8(*a*) is a perspective view showing the configuration of a test piece for measurement and FIG. 8(*b*) is an illustration showing the measuring state.

In case that the sample is a cylindrical member of the image forming apparatus such as a photoreceptor or a development roller, the cylindrical member is cut to have a width of 1–1.5 cm and is further cut in the lateral direction along ridge lines so as to obtain a test piece of a shape as shown in FIG. 8(*a*). The test piece is fixed to the test board at the predetermined position in such a manner that a surface to be radiated is flat to the direction of radiation of measurement light as shown in FIG. 8(*b*). Accordingly, photoelectron emitted from the test piece can be efficiently detected by a detector (photomultiplier).

In case of an intermediate transfer belt, a regulating blade, or a sheet-like photoreceptor, such a member is cut to have at least 1 square cm as a test piece because the radiation is conducted to a spot of 4 square mm. The test piece is fixed to the test board and measured in the same manner as described with reference to FIG. 8(*b*).

Figure 9:
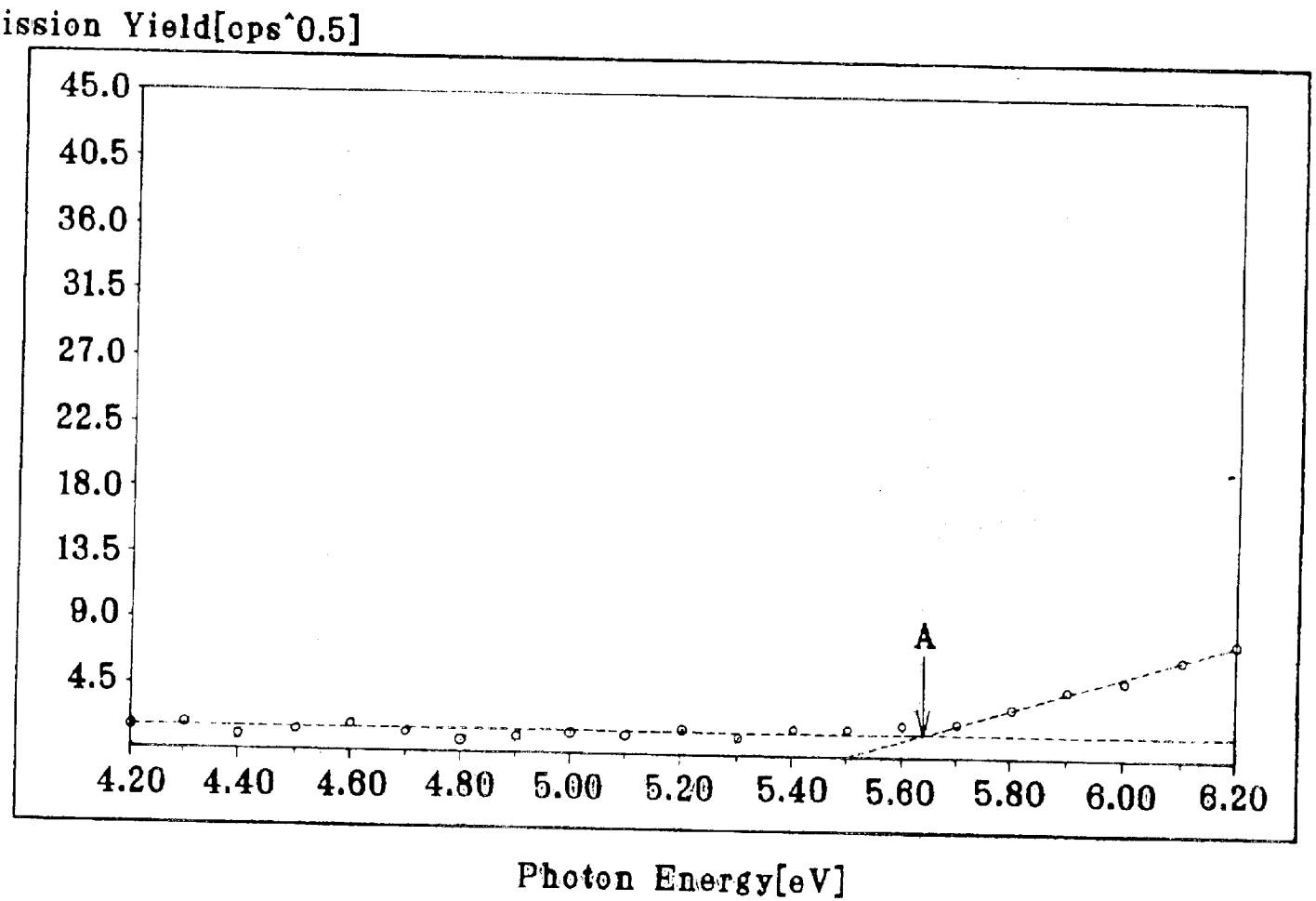
FIG. 9 is a chart showing measurement of the work function of toner (4) of the present invention by using a surface analyzer.

In this surface analysis, photoelectron emission is started at a certain energy value (eV) while scanning excitation energy of monochromatic beam from the lower side to the higher side. The energy value is called "work function (eV)". FIG. 9 shows an example of chart of a toner (4) according to the present invention, the chart being obtained by using the surface analyzer. FIG. 9 plots excitation energy (eV) as the abscissa and normalized photon emission yield ("n" power of photon yield per unit photon) as the ordinate so that a constant gradient (Y/eV) is obtained. In FIG. 9, the work function is indicated by an excitation energy (eV) at a critical point A.

In the image forming apparatus of the present invention, the work function ($\Phi_t$) of toner measured in the aforementioned manner is set to be larger than the work function ($\Phi_{OPC}$) of the surface of the latent image carrier (photoreceptor). The work function ($\Phi_t$) of toner is preferably from 5.4 to 5.9 eV, more preferably from 5.45 to 5.85 eV. The work function of toner less than 5.4 eV narrows down the available range of the latent image carrier and/or the intermediate transfer medium. On the other hand, the work function of toner exceeding 5.9 eV reduces the content of coloring pigment in the toner, thus reducing coloring property.

The work function ($\Phi_{OPC}$) of the surface of the latent image carrier (photoreceptor) is preferably from 5.2 to 5.6 eV, more preferably from 5.25 to 5.5 eV. The work function less than 5.2 eV makes the selection of available charge transport material difficult. On the other hand, the work function exceeding 5.6 eV makes the selection of available charge generation material difficult.

The work function ($\Phi_t$) of toner is preferably set to be larger than the work function ($\Phi_{OPC}$) of the surface of the latent image carrier (photoreceptor) by at least 0.2 eV, more preferably 0.25 eV or more, thereby having excellent charging property to negatively charged toner particles when it is in contact with the latent image carrier.

Since toner particles generally have particle size distribution, large-diameter toner particles are charged by contact with the development roller or the toner thickness regulating member, while small-diameter toner particles do not come in contact with the development roller or the toner thickness regulating member so that they are mixed in a regulated toner layer without being charged. The small-diameter toner particles not subjected to the contact electrification may be inversely charged due to dielectric polarization function of negatively charged toner particles which are subjected to the contact electrification. Accordingly, the toner containing positively charged toner particles is carried to a developing portion of the latent image carrier and the positively charged toner particles may adhere a region corresponding to non-image portion. It is expected that this may cause fog.

In the image forming apparatus of the present invention, positively charged small-diameter toner particles which are not subjected to the contact electrification by the toner regulating member can be changed to be negatively charged by contact with the photoreceptor. Therefore, no toner particles adhere to negatively charged non-image region, thereby reducing the fog. As will be described later, even with the same transferring voltage, the transfer efficiency may be improved, thereby obtaining high-quality images. Though there is no special limitation about the relation between the work functions of the regulating blade and the development roller and the work function of the toner, the work functions of the regulating blade and the development roller are preferably set to be smaller than the work function of the toner, thereby further preventing the production of inversely charged toner particles.

Though the following description for the image forming apparatus of the present invention will be made mainly with regard to the single-component developing method, the present invention can be adopted to the dual-component developing method. It should be noted that numerical range will be indicated with the former of same units being omitted, for example, "from 20 to 60 $\mu$m" instead of "from 20 $\mu$m to 60 $\mu$m". The same is true for other units.

The latent image carrier (organic photoreceptor) may be of a single layer organic type or a multi-layer organic type. A multi-layer organic photoreceptor consists of a charge generation layer, a charge transport layer which are sequentially laminated on a conductive supporting body via a known undercoat layer.

As the conductive supporting body, a known conductive supporting body, for example, having conductivity less than volume resistance $10^{10}\Omega$ cm can be used. Specific examples are a tubular supporting body of 20 mm to 90 mm $\phi$ formed by machining aluminium alloy, a supporting body made of polyethylene terephthalate film which is provided with conductivity by chemical vapor deposition of aluminium or conductive paint, and a tubular supporting body of 20 mm to 90 mm $\phi$ formed by molding conductive polyimide resin. The conductive supporting body may have a tubular shape, a belt-like shape, a plate shape, or a sheet shape. In addition, a metallic belt made by seamless processing a nickel electrocast tube or a stainless steel tube may be suitably employed.

As the undercoat layer, a known undercoat layer may be used. For example, the undercoat layer is disposed for improving the adhesive property, preventing moire phenomenon, improving the coating property of the charge generation layer as an upper layer thereof, and/or reducing residual potential during exposure. The resin as material of the undercoat layer preferably has high insoluble property relative to solvent used for a photosensitive layer because the photosensitive layer is applied on the resin. Examples of available resins are water soluble resins such as polyvinyl alcohol, casein, sodium polyacrylic acid, alcohol soluble resins such as polyvinyl acetate, copolymer nylon and methoxymethylate nylon, polyurethane, melamine resin, and epoxy resin. The foregoing resins may be used alone or in combination. These resin may contain metallic oxide such as titanium dioxide or zinc oxide.

As the charge generation pigment for use in the charge generation layer, a known material may be used. Specific examples are phthalocyanine pigments such as metallic phthalocyanine, metal-free phthalocyanine, azulenium salt pigments, squaric acid methine pigments, azo pigments having a carbazole skeleton, azo pigments having a triphenylamine skeleton, azo pigments having a diphenylamine skeleton, azo pigments having a dibenzothiophene skeleton, azo pigments having a fluorenone skeleton, azo pigments having an oxadiazole skeleton, azo pigments having a bis-stilbene skeleton, azo pigments having a distyryl oxadiazole skeleton, azo pigments having a distyryl carbazole skeleton, perylene pigments, anthraquinone pigments, polycyclic quinone pigments, quinone imine pigments, diphenylmethane pigments, triphenylmethane pigments, benzoquinone pigments, naphthoquinone pigments, cyanine pigments, azomethine pigments, indigoid pigments, and bisbenzimidazole pigments. The foregoing charge generation pigments may be used alone or in combination.

Examples of the binder resin for use in the charge generation layer include polyvinyl butyral resin, partially acetalized polyvinyl butyral resin, polyarylate resin, and vinyl chloride-vinyl acetate copolymer. As for the structural ratio between the binder resin and the charge generation material, the charge generation material is in a range from 10 to 1000 parts by weight relative to 100 parts by weight of the binder resin.

As the charge transport material for use in the charge generation layer, conventional materials may be used and the charge transport material is divided into an electron transport material and a positive hole transport material. Examples of the electron transport material include electron acceptor materials such as chloroanil, tetracyanoethylene, tetracyanoquinodimethane, 2,4,7-trinitro-9-fluorenone, palladiphenoquinone derivatives, benzoquinone derivatives, and naphthoquinone derivatives. These electron transport materials may be used alone or in combination.

Examples of the positive hole transport material include oxazole compounds, oxadiazole compounds, imidazole compounds, triphenylamine compounds, pyrazoline compounds, hydrazone compounds, stilbene compounds, phenazine compounds, benzofuran compounds, buthaziene compounds, benzizine compounds and, derivatives thereof. These positive hole transport materials may be used alone or in combination. The charge transport layer may contain antioxidant, age resistor, ultraviolet ray absorbent or the like for preventing deterioration of the aforementioned materials.

Examples of the binder resins for use in the charge transport layer include polyester, polycarbonate, polysulfone, polyarylate, poly-vinyl butyral, poly-methyl methacrylate, poly-vinyl chloride resin, vinyl chloride-vinyl acetate copolymer, and silicone resin. Among these, polycarbonate is preferable in view of the compatibility with the charge transport material, the layer strength, the solubility, and the stability as coating material. As for the structural ratio between the binder resin and the charge transport material, the charge transport material is in a range from 25 to 300 parts by weight relative to 100 parts by weight of the binder resin.

It is preferable to use a coating liquid for forming the charge generation layer and the charge transport layer. Example of solvents for use in the coating liquid include alcohol solvents such as methanol, ethanol, and isopropyl alcohol, ketone solvents such as acetone, methyl ethyl ketone, and cyclohexanone, amide solvents such as N,N-dimethyl horumu amide, and N,N-dimethyl aceto amide, ether solvents such as tetrahydrofuran, dioxane, and ethylene glycol monomethyl ether, ester solvents such as methyl acetate and ethyl acetate, aliphatic halogenated hydrocarbon solvents such as chloroform, methylene chloride, dichloroethylene, carbon tetrachloride, and trichloroethylene, and aromatic solvents such as benzene, toluene, xylene, and monochlor benzene. Selection from the above solvents depends on the kind of used binder resin.

For dispersing the charge generation pigment, it is preferable to disperse and mix by using a mechanical milling/dispersion method such as a sand mill method, a ball mill method, an attritor method, a planetary mill method.

Examples of the coating method for the undercoat layer, the charge generation layer and the charge transport layer include a dip coating method, a ring coating method, a spray coating method, a wire bar coating method, a spin coating method, a blade coating method, a roller coating method, and an air knife coating method. After coating, it is preferable to dry them at room temperature and then, heat-dry them at a temperature from 30 to 200° C. for 30 to 120 minutes. The thickness of the charge generation layer after being dried is in a range from 0.05 to 10 $\mu$m, preferably from 0.1 to 3 $\mu$m. The thickness of the charge transport layer after being dried is in a range from 5 to 50 $\mu$m, preferably from 10 to 40 $\mu$m.

A single layer organic photosensitive layer is formed by forming a charge generation layer, a charge transport layer, and a single layer organic photosensitive layer including a sensitizer, a binder, a solvent, and the like, on a conductive supporting body as described in the aforementioned organic laminated photoreceptor via an undercoat layer. The negatively charged single layer type organic photoreceptor may be made according to the disclosure of Japanese Patent Unexamined Publication 2000-19746.

Examples of charge generation materials for use in the single layer type organic photosensitive layer are phthalocyanine pigments, azo pigments, quinone pigments, perylene pigments, quinocyanine pigments, indigoid pigments, bisbenzimidazole pigments, and quinacridone pigments. Among these, phthalocyanine pigments and azo pigments are preferable. Examples of charge transport compounds are organic positive hole transport materials such as hydrazone compounds, stilbene compounds, phenylamine compounds, arylamine compounds, diphenyl buthaziene compounds, and oxazole compounds. Examples of the sensitizers are electron attractive organic compounds such as palladiphenoquinone derivatives, naphthoquinone derivatives, and chloroanil, which are also known as charge transport materials. Examples of the binders are thermoplastic resins such as polycarbonate resin, polyarylate resin, and polyester resin.

Proportions of the respective components are the binder: 40–75% by weight, the charge generation material: 0.5–20% by weight, the charge transport material: 10–50% by weight, the sensitizer: 0.5–30% by weight, preferably the binder: 45–65% by weight, the charge generation material: 1–20% by weight, the charge transport material: 20–40% by weight, and the sensitizer: 2–25% by weight. The solvent is preferably a solvent being insoluble relative to the undercoat layer. Examples of the solvent are toluene, methyl ethyl ketone, and tetrahydrofuran.

The respective components are milled and dispersed by a mixing apparatus such as a homo mixer, a ball mill, a sand mill, an attritor, or a paint conditioner so as to create a coating liquid. The coating liquid is applied on the undercoat layer by the dip coating method, the ring coating method, or the spray coating method to have a thickness after dried of 15 to 40 $\mu$m, preferably 20 to 35 $\mu$m, thereby forming a single layer organic photosensitive layer.

The non-magnetic single-component toner may be prepared by the pulverization method or the polymerization method. For making toner using the pulverization method, a resin binder, a pigment, a releasing agent, and a charge control agent are uniformly mixed by a Henschel mixer, melt and kneaded by a twin-shaft extruder. After cooling process, they are classified through the rough pulverizing-fine pulverizing process. Further, a fluidity improving agent is added as an external additive. In this manner, toner prepared by the pulverization is obtained.

As the binder resin, a known binder resin for toner may be used. Preferable examples are homopolymers or copolymers containing styrene or styrene substitute, such as polystyrene, poly-$\alpha$-methyl styrene, chloropolystyrene, and styrene-based copolymers such as styrene-chlorostyrene copolymers, styrene-propylene copolymers, styrene-butadiene copolymers, styrene-vinyl chloride copolymers, styrene-vinyl acetate copolymers, styrene-maleic acid copolymers, styrene-acrylate ester copolymer, styrene-methacrylate ester copolymers, styrene-acrylate ester-methacrylate ester copolymers, styrene-$\alpha$-chloracrylic methyl copolymer, styrene-acrylonitrile-acrylic copolymers, and styrene-vinyl methyl ether copolymers; polyester resins, epoxy resins, polyurethane modified epoxy resins, silicone modified epoxy resin, vinyl chloride resins, rosin modified maleic acid resins, phenyl resins, polyethylene, polypropylene, ionomer resins, polyurethane resins, silicone resins, ketone resins, ethylene-ethylacrylate copolymers, xylene resins, polyvinyl butyral resins, terpene resins, phenolic resins, and aliphatic or alicyclic hydrocarbon resins. These resins may be used alone or in blended state. Among these resins, styrene-acrylate ester-based resins, styrene-methacrylate ester-based resins, and polyester resins are especially preferable in the present invention. The binder resin preferably has a glass-transition temperature in a range from 50 to 75° C. and a flow softening temperature in a range from 100 to 150° C.

As the coloring agent, a known coloring agent for toner may be used. Examples are Carbon Black, Lamp Black, Magnetite, Titan Black, Chrome Yellow, Ultramarine Blue, Aniline Blue, Phthalocyanine Blue, Phthalocyanine Green, Hansa Yellow G, Rhodamine 6G, Chalcone Oil Blue, Quinacridon, Benzidine Yellow, Rose Bengal, Malachite Green lake, Quinoline Yellow, C.I. Pigment red 48:1, C.I. Pigment red 122, C.I. Pigment red 57:1, C.I. Pigment red 122, C.I. Pigment red 184, C.I. Pigment yellow 12, C.I. Pigment yellow 17, C.I. Pigment yellow 97, C.I. Pigment yellow 180, C.I. Solvent yellow 162, C.I. Pigment blue 5:1, and C.I. Pigment blue 15:3. These coloring agents and pigments can be used alone or in blended state.

As the releasing agent, a known releasing agent for toner may be used. Specific examples are paraffin wax, micro wax, microcrystalline wax, candelilla wax, carnauba wax, rice wax, montan wax, polyethylene wax, polypropylene wax, oxygen convertible polyethylene wax, and oxygen convertible polypropylene wax. Among these, polyethylene wax, polypropylene wax, carnauba wax, or ester wax are preferably employed.

As the charge control agent, a known charge control agent for toner may be used. Specific examples are Oil Black, Oil Black BY, Bontron S-22 (available from Orient Chemical Industries, LTD.), Bontron S-34 (available from Orient Chemical Industries, LTD.); metal complex compounds of salicylic acid such as E-81 (available from Orient Chemical Industries, LTD.), thioindigo type pigments, sulfonyl amine derivatives of copper phthalocyanine, Spilon Black TRH (available from Hodogaya Kagaku K. K.), calix arene type compounds, organic boron compounds, quaternary ammonium salt compounds containing fluorine, metal complex compounds of monoazo, metal complex compounds of aromatic hydroxyl carboxylic acid, metal complex compounds of aromatic di-carboxylic acid, and polysaccharides. Among these, achromatic or white agents are especially preferable for color toner.

Proportions (by weight) in the toner prepared by the pulverization are the coloring agent: 0.5–15 parts, preferably 1–10 parts, the releasing agent: 1–10 parts, preferably 2.5–8 parts, and the charge control agent: 0.1–7 parts, preferably 0.5–5 parts relative to 100 parts of the binder resin.

In the toner prepared by the pulverization of the present invention, in order to improve the transfer efficiency, the toner is preferably spheroidized. For this, it is preferable to use such a machine allowing the toner to be pulverized into relatively spherical particles. For example, when the pulverization is carried by using a turbo mill (available from Kawasaki Heavy Industries, Ltd.), the degree of circularity may be 0.94 maximum. Alternatively, when treatment after pulverization is carried by using a hot air spheroidizing apparatus: Surfusing System SFS-3 (available from Nippon Pneumatic Mfg. Co., Ltd.), the degree of circularity may be 1.00 maximum.

The polymerization method may be suspension polymerization method or emulsion polymerization method. In the suspension polymerization, a monomer compound is prepared by melting or dispersing a coloring agent, a releasing agent, and, if necessary, a dye, a polymerization initiator, a cross-linking agent, a charge control agent, and other additive(s) into polymerizable monomer. By adding the monomer compound into an aqueous phase containing a suspension stabilizer (water soluble polymer, hard water soluble inorganic material) with stirring, the monomer compound is polymerized and granulated, thereby forming toner particles having a desired particle size.

In the emulsion polymerization, a monomer, a releasing agent and, if necessary, a polymerization initiator, an emulsifier (surface active agent), and the like are dispersed into a water and are polymerized. During the coagulation, a coloring agent, a charge control agent, and a coagulant (electrolyte) are added, thereby forming toner particles having a desired particle size.

Among the materials for the polymerization method, the coloring agent, the releasing agent, the charge control agent, and the fluidity improving agent may be the same materials for the toner prepared by the pulverization.

As the polymerizable monomer, a known monomer of vinyl series may be used. Examples include: styrene, o-methylstyrene, m-methylstyrene, p-methylstyrene, α-methylstyrene, P-methoxystyrene, p-ethylstyrene, vinyl toluene, 2,4-dimethylstyrene, p-n-butylstyrene, p-phenylstyrene, p-chlorostyrene, di-vinylbenzene, methyl acrylate, ethyl acrylate, propyl acrylate, n-butyl acrylate, isobutyl acrylate, n-octyl acrylate, dodecyl acrylate, hydroxyethyl acrylate, 2-ethyl hexyl acrylate, phenyl acrylate, stearyl acrylate, 2-chloroethyl acrylate, methyl methacrylate, ethyl methacrylate, propyl methacrylate, n-butyl methacrylate, isobutyl methacrylate, n-octyl methacrylate, dodecyl methacrylate, hydroxyethyl methacrylate, 2-ethyl hexyl methacrylate, stearyl methacrylate, phenyl methacrylate, acrylic acid, methacrylic acid, maleic acid, fumaric acid, cinnamic acid, ethylene glycol, propylene glycol, maleic anhydride, phthalic anhydride, ethylene, propylene, butylene, isobutylene, vinyl chloride, vinylidene chloride, vinyl bromide, vinyl fluoride, vinyl acetate, vinyl propylene, acrylonitrile, methacrylonitrile, vinyl methyl ether, vinyl ethyl ether, vinyl ketone, vinyl hexyl ketone, and vinyl naphthalene. Examples of fluorine-containing monomers are 2,2,2-torifluoroethylacrylate, 2,3,3-tetrafluoropropylacrylate, vinyliden fluoride, ethylene trifluororide, ethylene tetrafluoride, and trifluoropropyrene. These are available because the fluorine atoms are effective for negative charge control.

As the emulsifier (surface active agent), a known emulsifier may be used. Examples are dodecyl benzene sulfonic acid sodium, sodium-tetradecyl sulfate, pentadecyl sodium sulfate, sodium octylsulphate, sodium oleate, sodium laurate, potassium stearate, calcium oleate, dodecylammonium chloride, dodecylammonium bromide, dodecyltrimethylammonium bromide, dodecylpyridinium chloride, hexadecyltrimethylammonium bromide, dodecylpolyoxy ethylene ether, hexadecylpolyoxy ethylene ether, laurylpolyoxy ethylene ether, and sorbitan monooleate polyoxy ethylene ether.

As the polymerization initiators, a known polymerization initiator may be used. Examples include potassium persulfate, sodium persulfate, ammonium persulfate, hydrogen peroxide, 4,4'-azobis-cyano valeric acid, t-butyl hydro peroxide, benzoyl peroxide, and 2,2'-azobis-isobutyronitrile.

As the coagulant (electrolyte), a known coagulant may be used. Examples include sodium chloride, potassium chloride, lithium chloride, magnesium chloride, calcium chloride, sodium sulfate, potassium sulfate, lithium chloride, magnesium sulfate, calcium sulfate, zinc sulfate, aluminium sulfate, and iron sulfate.

Description will be made as regard to how to adjust the degree of circularity of the toner prepared by the polymerization. In the emulsion polymerization method, the degree of circularity can be freely changed by controlling the temperature and time in the coagulating process of secondary particles. The degree of circularity is in a range from 0.94 to 1.00. The suspension polymerization method enables to make perfect spherical toner particles. The degree of circularity is in a range from 0.98 to 1.00. By heating the toner particles at a temperature higher than the glass-transition temperature of toner to deform them for adjusting the circularity, the degree of circularity can be freely adjusted in a range from 0.94 to 0.98.

There is another method as the polymerization method which is a dispersion polymerization method. This method is discussed in, for example, Japanese Patent Unexamined Publication No. 63-304002. In this case, since the shape of each particle may be close to the perfect sphere, the particles are heated at a temperature higher than the glass-transition temperature of toner so as to form the particles into a desired shape.

The toner prepared by either of the pulverization or the polymerization preferably has a glass-transition temperature in a range from 50 to 100° C., preferably from 55 to 90° C., and a flow softening temperature in a range from 70 to 130° C., preferably from 75 to 120° C.

The toner prepared by either of the pulverization or the polymerization preferably has a mean particle diameter from 4 to 10 μm. Especially, the toner prepared by pulverization preferably has a number mean particle diameter ($D_{50}$) from 5 μm to 10 μm, more preferably from 6 μm to 9 μm, in which particles having a particle diameter of 3 μm or less occupy 20% or less, preferably 10% or less of the toner, based on the number. On the other hand, the toner prepared by polymerization preferably has a number mean particle diameter ($D_{50}$) from 4 μm to 9 μm, more preferably from 4.5 am to 8 μm, in which particles having a particle diameter of 3 μm or less occupy 5% or less, preferably 3% or less of the toner, based on the number.

The degree of circularity (sphericity) of the toner prepared by either of the pulverization or the polymerization is preferably 0.91 or more. Though the degree of circularity in a range from 0.91 to 0.94 can improve the transfer efficiency, positively charged toner particles may be created. Therefore, the best degree of circularity is 0.95 or more. In case of the degree of circularity up to 0.97, a cleaning blade is preferably used. In case of the higher degree, a brush cleaning is preferably used with the cleaning blade.

As the fluidity improving agent, a known inorganic or organic fluidity improving agent for toner may be used. Examples are fine particles of silica, titanium dioxide, alumina, magnesium fluoride, silicon carbide, boron carbide, titanium carbide, zirconium carbide, boron nitride, titanium nitride, zirconium nitride, magnetite, molybdenum disulfide, aluminum stearate, magnesium stearate, zinc stearate, calcium stearate, metallic salt titanate, and silicon metallic salt.

These fine particles are preferably processed by a hydrophobic treatment with a silane coupling agent, a titanate coupling agent, a higher fatty, silicone oil. Besides the aforementioned fine particles, examples include acrylic resin, styrene resin, and fluororesin. These fluidity improving agents can be used alone or in blended state. The adding amount of the fluidity improving agent is preferably from 0.1 to 5% by weight, more preferably from 0.5 to 4.0% by weight relative to the toner.

The fluidity improving agent as an external additive of toner preferably has a mean particle diameter ($D_{50}$) of primary particles in a range from 5 to 150 nm, more preferably in a range from 7 to 100 nm, and a specific surface area of 2 to 500 $m^2/g$, more preferably in the range of from 5 to 400 $m^2/g$, as measured according to the BET method.

In the present invention, the number mean particle diameters and the degrees of circularity of the toner particles are measured by FPIA2100 available from Sysmex corporation and the particle diameters of the fluidity improving agent particles are measured by the electron microscope.

FIG. 1 shows an example of the image forming apparatus of a contact developing type according to the present invention. An organic photoreceptor 1 is a photosensitive drum which is 24–86 mm in diameter and rotates at a surface velocity of 60–300 mm/sec. After the surface of the organic photoreceptor 1 is uniformly negatively charged by a corona charging device 2, the organic photoreceptor 1 is exposed by an exposure device 3 according to information to be recorded. In this manner, an electrostatic latent image is formed on the organic photoreceptor 1.

A developing device composed of a development roller 10 is a single-component developing device which supplies a non-magnetic single-component toner T as mentioned above to the organic photoreceptor to reverse-developing the electrostatic latent image on the organic photoreceptor, thereby forming a visible image. The non-magnetic single-component toner T is housed in the developing device. The toner is supplied to the development roller by a supply roller 8 which rotates in the counter-clockwise direction as shown in FIG. 1. The development roller 10 rotate in the counter-clockwise direction as shown in FIG. 1 with holding the toner T, supplied by the supply roller 8, adhering thereon so as to carry the toner T to contact portion with the organic photoreceptor, thereby making the electrostatic latent image on the organic photoreceptor 1 visible.

The development roller 10 may be a roller made of a metallic pipe having a diameter 16–24 mm, of which surface is treated by plating or blasting or which is formed on its peripheral surface with a conductive elastic layer made of NBR, SBR, EPDM, polyurethane rubber, or silicone rubber to have a volume resistivity of $10^4$ to $10^8$ Ω cm and hardness of 40 to 70° (Asker A hardness). A developing bias voltage is applied to the development roller via the shaft of the pipe or the center shaft thereof. The entire developing device composed of the development roller, the supply roller, and a toner regulating blade 9 is biased against the organic photoreceptor 1 by a biasing means such as a spring (not shown) with a pressure load of 20 to 100 gf/cm, preferably 25 to 70 gf/cm to have a nip width of 1 to 3 mm. It should be noted that the pressure load is a load per a unit area of the contact width in a direction perpendicular to the nip width when the entire developing device is pressed against the organic photoreceptor 1.

The regulating blade 9 is formed by pasting rubber tips on a SUS, a phosphor bronze, a rubber plate, a metal sheet. The work function of the regulating blade at the contact area with the toner is preferably in a range of 4.8 to 5.4 eV, i.e. smaller than the work function of the toner. The regulating blade is biased against the development roller by a biasing means such as a spring (not shown) or the bounce itself as an elastic member with a linear load of 25 to 50 gf/cm to make the toner layer on the development roller into a uniform thickness of 10 to 30 μm, preferably 13 to 25 μm and to regulate such that the number of layers made up of toner particles becomes 1.2 to 3, preferably 1.5 to 2.5. When the thickness of the toner layer on the development roller is regulated such that the number of layers made up of toner particles becomes 2 or more (toner carrying amount: 0.5 $mg/cm^2$), small-diameter toner particles among toner particles may pass without contact with the toner regulating member so that such toner particles become positively charged toner particles and are easy to enter in the regulated toner layer. Alternatively, a voltage may be applied to the regulating blade 9 to conduct charge injection into toner particles being in contact with the blade, thereby controlling the charge of toner.

In the contact developing method, the dark potential of the photoreceptor is preferably set in a range of −500 to −700 V, the light potential thereof is preferably set in a range of −50 to −150 V, and the developing bias is preferably set in a range of −100 to −400 V, but not shown. The development roller and the supply roller are preferably in the same potential. The peripheral velocity of the development roller which rotates in the counter-clockwise direction is preferably set to have a ratio of peripheral velocity of 1.2 to 2.5, preferably 1.5 to 2.2 relative to that of the organic photoreceptor which rotates in the clockwise direction. Therefore, even small-diameter toner particles are reliably subjected to the contact triboelectric charging with the organic photoreceptor.

FIG. 2 shows an example of the image forming apparatus of a non-contact developing type. In this method, the development roller 10 and the photoreceptor 1 are arranged to have a developing gap L therebetween. The developing gap is preferably in a range from 100 to 350 $\mu$m. As for the developing bias, the voltage of a direct current (DC) is preferably in a range from −200 to −500 V and an alternating current (AC) to be superimposed on the direct current is preferably in a range from 1.5 to 3.5 kHz, and P-P voltage is preferably in a range from 1000 to 1800 V, but not shown. The peripheral velocity of the development roller which rotates in the counter-clockwise direction is preferably set to have a ratio of peripheral velocity of 1.0 to 2.5, preferably 1.2 to 2.2 relative to that of the organic photoreceptor which rotates in the clockwise direction.

The development roller 10 rotates in the counter-clockwise direction as shown in FIG. 2 with holding the toner T, supplied by the supply roller 8, adhering thereon so as to carry the toner T to a facing portion with the organic photoreceptor. By applying a bias voltage, composed of an alternating current superimposed on a direct current, to the facing portion between the organic photoreceptor and the development roller, the toner T vibrates between the surface of the development roller and the surface of the organic photoreceptor to develop an image. Toner particles adhere to the photoreceptor during the vibration of the toner T between the surface of the development roller and the surface of the organic photoreceptor, whereby positively charged toner particles become negatively charged toner particles.

The following description will be made for a case that a transfer medium 5 is a recording medium such as a paper or an OHP sheet in the image forming apparatuses shown in FIG. 1 and FIG. 2. The recording medium is fed between the organic photoreceptor 1 and a backup roller (transfer roller) 7. The transfer roller is arranged for pressing the recording medium against the photoreceptor and is subjected to a voltage of a polarity opposite to the polarity of the toner.

The transfer roller has a metallic shaft having a diameter of 10 to 20 mm and is provided with an elastic layer, a conductive layer, and a resistance outer layer which are laminated on the peripheral surface of the metallic shaft in this order. The resistance outer layer may be a resistance sheet made by dispersing conductive fine particles such as conductive carbon particles into a resin such as fluororesin, polyvinyl butyral, or a rubber such as polyurethane and thus having excellent flexibility. The resistance outer layer preferably has a smooth surface, a volume resistivity of $10^7$ to $10^{11}$ Ω cm, preferably $10^8$ to $10^{10}$ Ω cm, and a thickness of 0.02 to 2 mm.

The conductive layer may be selected from a group consisting of a conductive resin made by dispersing conductive fine particles such as conductive carbon particles into a resin such as polyester resin, a metallic sheet, and a conductive adhesive and has a volume resistivity of $10^5$ Ω cm or less. The elastic layer is required to elastically deform when the transfer roller is pressed against the organic photoreceptor and to rapidly return to the original configuration when the pressure is cancelled. Therefore, the elastic layer is made of an elastic material such as foamed sponge rubber. The foamed sponge rubber may have either of the open-cell structure and the closed-cell structure and preferably has rubber hardness of 30 to 80 (Asker C hardness) and a thickness of 1 to 5 mm. Because of the elastic deformation of the transfer roller, the organic photoreceptor and the recording medium can be in close contact to have a wide nip width.

In case of the contact developing type as shown in FIG. 1, the pressing load of the recording medium on the organic photoreceptor by the transfer roller is preferably in a range from 20 to 40 gf/cm and the nip width is preferably in a range from 1 to 8 mm. Most of toner particles including small-diameter toner particles can be negatively charged toner by the contact between the organic photoreceptor and the development roller. A transfer voltage to be applied to the transfer roller is preferably a voltage of a polarity opposite to the polarity of the toner in a rage from +200 to +600 V.

In case of the non-contact developing type as shown in FIG. 2, the pressing load of the recording medium on the organic photoreceptor by the transfer roller is preferably in a range from 25 to 60 gf/cm, preferably from 35 to 50 gf/cm which is greater than that of the contact developing type by nearly thirty percent. This ensure the contact between the toner particles and the organic photoreceptor, whereby the toner particles can be negatively charged toner so as to improve the transfer efficiency.

In the image forming apparatuses shown in FIG. 1 and FIG. 2, residual toner particles remaining on the organic photoreceptor after the transfer of the toner from the organic photoreceptor to the recording medium are removed by a cleaning blade 4 and electrostatic charge on the photoreceptor is erased by an erase lump, whereby the organic photoreceptor can be reusable. The image forming apparatus of the present invention can prevent inversely charged toner particles, thereby reducing the amount of toner particles remaining on the organic photoreceptor and thus reducing the size of a cleaning container.

The following description will be made for a case that a transfer medium 5 is an intermediate transfer medium in the image forming apparatuses shown in FIG. 1 and FIG. 2.

In the image forming apparatus of the present invention, when the transfer medium 5 is an intermediate transfer medium, the work function ($\Phi_t$) of toner is preferably larger than the work function ($\Phi_{TM}$) of the surface of the intermediate transfer medium as described above. The work function ($\Phi_t$) of the toner is preferably in a range from 5.4 to 5.9 eV, more preferably from 5.45 to 5.85 eV, while the work function ($\Phi_{TM}$) of the surface of the intermediate transfer medium is preferably in a range from 4.9 to 5.5 eV, more preferably from 4.95 to 5.45 eV. The work function ($\Phi_{TM}$) of the surface of the intermediate transfer medium larger than 5.5 eV is undesirable because the material design for toner itself should be difficult. On the other hand, the work function ($\Phi_{TM}$) of the surface of the intermediate transfer medium smaller than 4.9 eV is also undesirable because the amount of conductive material in the intermediate transfer medium should be too large so that the mechanical strength of the intermediate transfer medium is reduced.

The difference between the work function ($\Phi_t$) of the toner and the work function ($\Phi_{TM}$) of the surface of the intermediate transfer medium is at least 0.2 eV, preferably 0.25 eV or greater, thereby converting positively charged toner particles adhering to image portions of the latent image carrier with negatively charged toner particles into negatively charged toner particles and thus improving the transfer efficiency from the latent image carrier to the intermediate transfer medium. This image forming apparatus is especially effective with the employment of the non-contact developing method.

In the image forming apparatus of the present invention, the work function ($\Phi_{OPC}$) of the surface of the latent image carrier, the work function ($\Phi_t$) of the toner, and the work function ($\Phi_{TM}$) of the surface of the intermediate transfer medium are preferably set to satisfy a relation $\Phi_t > \Phi_{OPC} > \Phi_{TM}$.

The difference between each two of the work function ($\Phi_{OPC}$) of the surface of the latent image carrier, the work function ($\Phi_t$) of the toner, and the work function ($\Phi_{TM}$) of the surface of the intermediate transfer medium is at least 0.2 eV, preferably 0.25 eV or more. This is very preferable because the toner particles can be reliably converted into negatively charged toner particles at both the contact between the toner and the latent image carrier and the contact between the toner on the latent image carrier and the intermediate transfer medium, thereby further improving the transfer efficiency.

As the intermediate transfer medium, examples are a transfer drum and a transfer belt. The transfer medium of a transfer belt type can be categorized into two types having different kinds of substrates. One is a type in which a transfer layer as an outer layer is disposed on a resin film or seamless belt and the other is a type in which a transfer layer as an outer layer is disposed on an elastic base layer.

The transfer medium of a transfer drum type can also be categorized into two types having different kinds of substrates. One is a type corresponding to the photoreceptor comprising a rigid drum, for example a drum made of aluminium, and an organic photosensitive layer formed on the drum. That is, the transfer medium of this type comprising a rigid drum substrate made of aluminium or the like and an elastic transfer layer as an outer layer formed on the drum substrate. The other is a type corresponding to the photoreceptor, a so-called "elastic photoreceptor", i.e. comprising a belt-like supporting body or an elastic supporting body made of rubber and a photosensitive layer formed on the supporting body. That is, the transfer medium of this type comprising a rigid drum substrate made of aluminium or the like and a transfer layer as an outer layer disposed directly or via a conductive intermediate layer on the drum substrate.

As the substrate, a known conductive or insulating substrate may be used. In case of the transfer belt, the volume resistivity is preferably in a range from $10^4$ to $10^{12}$ Ω cm, preferably $10^6$ to $10^{11}$ Ω cm. There are following two kinds according to the kind of substrate.

As the method for forming a film or a seamless belt, a material prepared by dispersing a conductive material such as conductive carbon black, conductive titanium oxide, conductive tin oxide, or conductive silica into an engineering plastic such as modified polyimide, thermosetting polyimide, polycarbonate, ethylene tetrafluoroethylene copolymer, poly vinyliden fluoride, or nylon alloy is extruded into a semi-conductive film substrate having a thickness of 50–500 μm and is made to be seamless substrate. Further, a surface protective layer for reducing the surface energy and preventing filming of toner is formed on the outer surface by coating fluorine to have a thickness of 5 to 50 μm. In this manner, the seamless belt is formed. The coating method may be a dip coating method, a ring coating method, a spray coating method, or another coating method. To prevent cracking at edges and elongation and serpentine motion of the transfer belt, tapes of PET film or ribs of polyurethane rubber having a thickness of 80 μm are attached to the edges of the transfer belt.

In case of the substrate made of a film sheet, the ends of the film sheet are ultrasonic-welded so as to form a belt. As concretely described, a conductive layer and an outer layer are formed on a sheet film before the ultrasonic welding so as to form a transfer belt having desired characteristics. More concretely, in case of using a polyethylene terephthalate film having a thickness of 60 to 150 μm as an insulating substrate, aluminium is deposited on the surface of the film, an intermediate conductive layer composed of a conductive material such as carbon black and resin is further coated if necessary, and a semi-conductive outer layer made of polyurethane resin, fluororesin, conductive material, fluorine fine particles having a surface resistivity higher than that of the intermediate layer is formed, thereby forming the transfer belt. In case that a resistance layer which does not need a large amount of heat for drying is allowed to be formed, the resistance layer may be formed after the ultrasonic welding of the film with aluminium deposition.

As the method for forming an elastic substrate of rubber or the like a material prepared by dispersing the aforementioned conductive material into silicone rubber, polyurethane rubber, NBR (nitrile rubber), or EPDM (ethylene propylene rubber) is extruded into a semi-conductive rubber belt having a thickness of 0.8 to 2.0 mm. After that, the surface of the belt is processed by an abrasive such as a sand paper or a polisher to have desired surface roughness. Though this can be used without any additional layer, a surface protective layer may be further formed thereon similarly to the above case.

The transfer drum preferably has a volume resistivity of $10^4$ to $10^{12}$ Ω cm, preferably $10^7$ to $10^{11}$ Ω cm. As the method of forming a transfer drum, a conductive elastic substrate is prepared by forming a conductive intermediate layer of an elastic material on a metallic cylinder made of aluminium or the like. Further, a semi-conductive surface protective layer for reducing the surface energy and preventing filming of toner is made by, for example, coating fluorine to have a thickness of 5 to 50 μm.

As the method for forming a conductive elastic substrate, a conductive rubber material is prepared by mixing, kneading, and dispersing a conductive material such as carbon black, conductive titanium oxide, conductive tin oxide, or conductive silica into a rubber material such as silicone rubber, polyurethane rubber, NBR (nitrile rubber), or EPDM (ethylene propylene rubber), butadiene rubber, styrene-butadiene rubber, isoprene rubber, chloroprene rubber, butyl rubber, epichlorohydrin rubber, or fluororubber. The conductive rubber material is vulcanized onto an aluminium cylinder having a diameter of 90 to 180 mm and then ground to have a thickness of 0.8 to 6 mm and a volume resistivity of $10^4$ to $10^{10}$ Ω cm.

After that, a semi-conductive outer layer made of polyurethane resin, fluororesin, conductive material, fluorine fine particles is formed to have a thickness 15–40 μm, thereby forming a transfer drum having a desired volume resistivity of $10^7$ to $10^{11}$ Ω cm. At this point, the surface roughness is preferably 1 μmRa or less. As an alternative method, a semi-conductive tube made of fluororesin or the like is covered onto a conductive elastic substrate formed in the same manner as described above and is shrank by heat, thereby forming a transfer drum having a desired outer layer and a desired resistivity.

Voltage to be applied as a primary transfer voltage to the conductive layer of the transfer drum or transfer belt is preferably in a range from +250 to +600 V. Voltage to be applied as a secondary transfer voltage to the recording medium such as a paper is preferably in a range from +400 to +2800 V.

Figure 3:
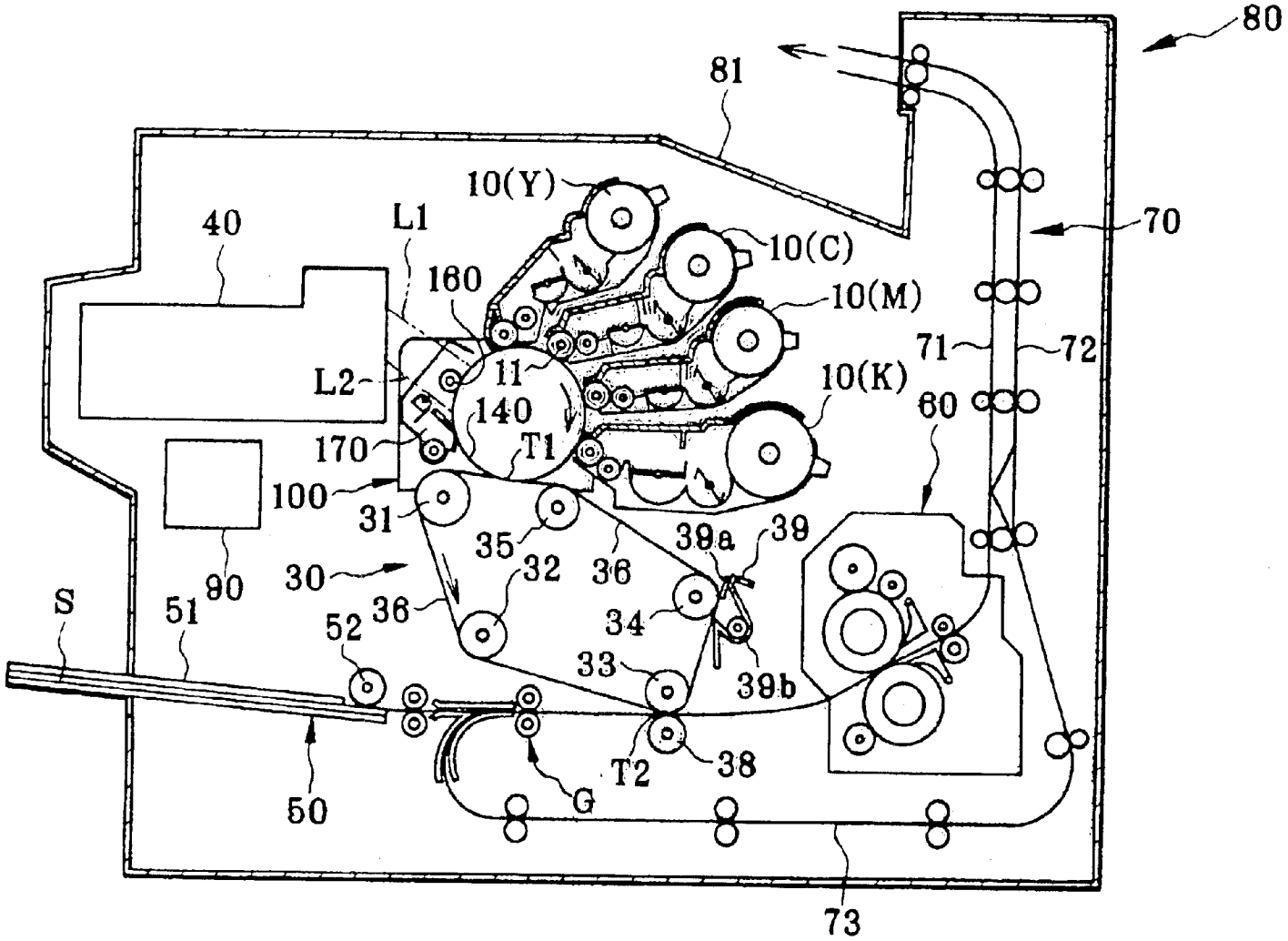
FIG. 3 is an explanatory illustration showing an example of a full color printer according to the image forming apparatus of the present invention.
Figure 4:
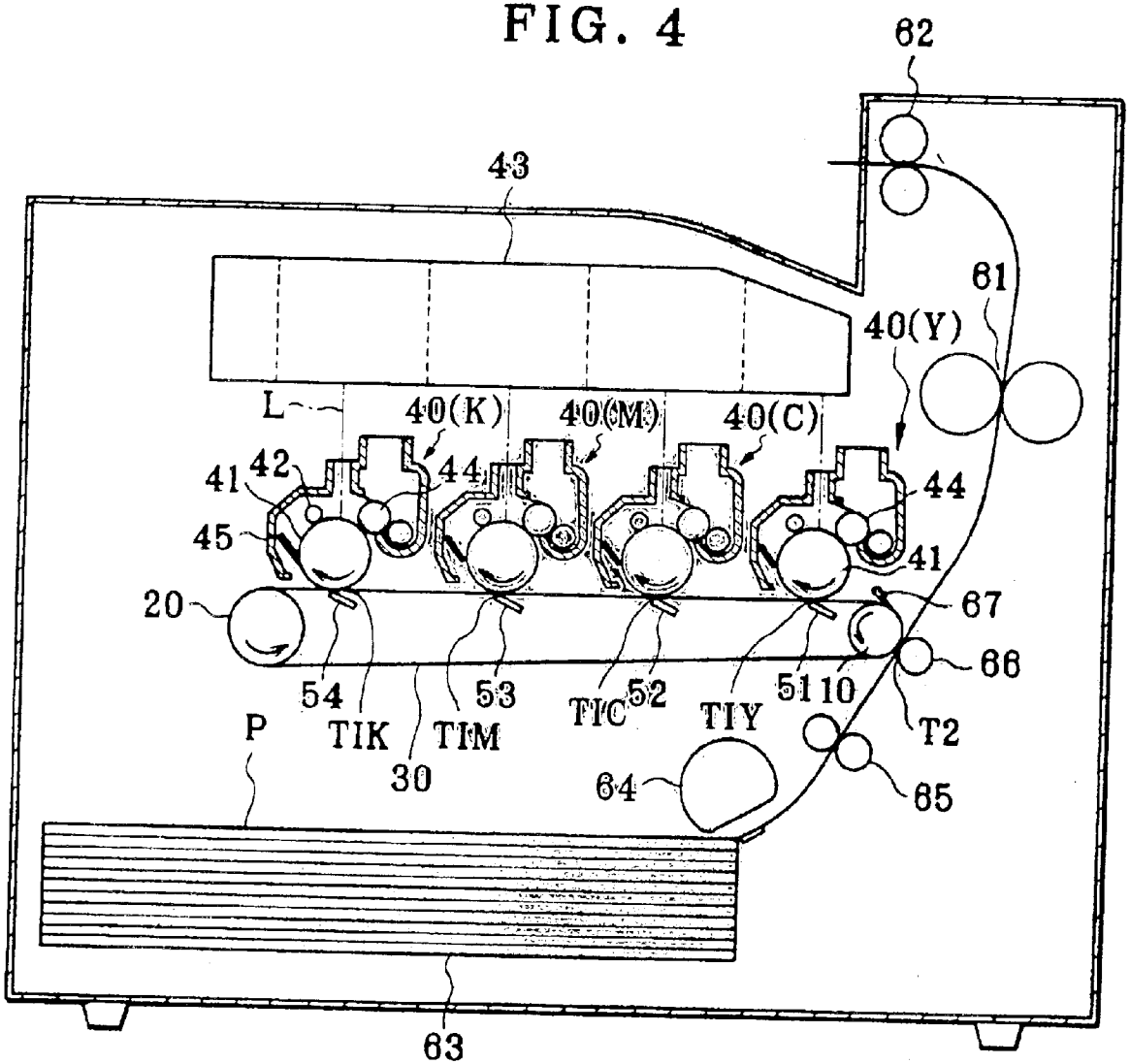
FIG. 4 is an explanatory illustration showing an example of tandem type according to the image forming apparatus of the present invention.

By combining developing devices of conducting developing process as shown in FIG. 1 or FIG. 2 with respective four color toners (developers) of yellow Y, cyan C, magenta M, and black K and the photoreceptor, an apparatus capable of forming a full color image can be provided. FIG. 3 shows an example of a full color printer of a rotary type and FIG. 4 shows an example of a full color printer of a tandem type.

In FIG. 3, a numeral 100 designates a latent image carrier cartridge in which a latent image carrier unit is assembled. In this example, the photoreceptor cartridge is provided so that the photoreceptor and a developing unit can be separately installed. A negative charged photoreceptor (latent image carrier) 140 having a work function satisfying the relation of the present invention is rotated in a direction of arrow by a suitable driving means (not shown). Arranged around the photoreceptor 140 along the rotational direction are a charging roller 160 as the charging means, developing devices 10 (Y, M, C, K) as the developing means, an intermediate transfer device 30, and a cleaning means 170.

The charging roller 160 is in contact with the outer surface of the photoreceptor 140 to uniformly charge the outer surface of the same. The uniformly charged outer surface of the photoreceptor 140 is exposed to selective light L1 corresponding to desired image information by an exposing unit 140, thereby forming an electrostatic latent image on the photoreceptor 140. The electrostatic latent image is developed with developers by the developing devices 10.

The developing devices 10 are a developing device 10Y for yellow, a developing device 10M for magenta, a developing device 10C for cyan, and a developing device 10K for black. These developing devices 10Y, 10C, 10M, 10K can swing so that the development roller (developer carrier) 11 of only one of the developing devices is selectively in press contact with the photoreceptor 140. These developing devices 10 hold negatively charged toners, having work function satisfying the relation of the present invention relative to the work function of the photoreceptor, on the respective development rollers. Each developing device 10 supplies either one of toners of yellow Y, magenta M, cyan C, and black K to the surface of the photoreceptor 140, thereby developing the electrostatic latent image on the photoreceptor 140. Each development roller 11 is composed of a hard roller, for example a metallic roller which is processed to have rough surface. The developed toner image is transferred to an intermediate transfer belt 36 of the intermediate transfer device 30. The cleaning means 170 comprises a cleaner blade for scraping off toner particles T adhering to the outer surface of the photoreceptor 140 after the transfer and a toner receiving element for receiving the toner particles scrapped by the cleaner blade.

The intermediate transfer device 30 comprises a driving roller 31, four driven rollers 32, 33, 34, 35, and the intermediate transfer belt 36 wound onto and tightly held by these rollers. The driving roller 31 has a gear (not shown) fixed at the end thereof and the gear is meshed with a driving gear of the photoreceptor 140 so that the driving roller 31 is rotated at substantially the same peripheral velocity as the photoreceptor 140. As a result, the intermediate transfer belt 36 is driven to circulate at substantially the same peripheral velocity as the photoreceptor 140 in the direction of arrow.

The driven roller 35 is disposed at such a position that the intermediate transfer belt 36 is in press contact with the photoreceptor 140 by the tension itself between the driving roller 31 and the driven roller 35, thereby providing a primary transfer portion T1 at the press contact portion between the photoreceptor 140 and the intermediate transfer belt 36. The driven roller 35 is arranged at an upstream of the circulating direction of the intermediate transfer belt and near the primary transfer portion T1.

On the driving roller 31, an electrode roller (not shown) is disposed via the intermediate transfer belt 36. A primary transfer voltage is applied to a conductive layer of the intermediate transfer belt 36 via the electrode roller. The driven roller 32 is a tension roller for biasing the intermediate transfer belt 36 in the tensioning direction by a biasing means (not shown). The driven roller 33 is a backup roller for providing a secondary transfer portion T2. A second transfer roller 38 is disposed to face the backup roller 33 via the intermediate transfer belt 36. A secondary transfer voltage is applied to the secondary transfer roller. The secondary transfer roller can move to separate from or to come in contact with the intermediate transfer belt 36 by a sifting mechanism (not shown). The driven roller 34 is a backup roller for a belt cleaner 39. The belt cleaner 39 can move to separate from or to come in contact with the intermediate transfer belt 36 by a shifting mechanism (not shown).

The intermediate transfer belt 36 is a dual-layer belt comprising the conductive layer and a resistive layer formed on the conductive layer, the resistive layer being brought in press contact with the photoreceptor 140. The conductive layer is formed on an insulating substrate made of synthetic resin. The primary transfer voltage is applied to the conductive layer through the electrode roller as mentioned above. The resistive layer is removed in a band shape along the side edge of the belt so that the corresponding portion of the conductive layer is exposed in the band shape. The electrode roller is arranged in contact with the exposed portion of the conductive layer.

In the circulating movement of the intermediate transfer belt 36, the toner image on the photoreceptor 140 is transferred onto the intermediate transfer belt 36 at the primary transfer portion T1, the toner image transferred on the intermediate transfer belt 36 is transferred to a sheet (recording medium) S such as a paper supplied between the secondary transfer roller 38 and the transfer belt at the secondary transfer portion T2. The sheet S is fed from a sheet feeder 50 and is supplied to the secondary transfer portion T2 at a predetermined timing by a pair of gate rollers G. Numeral 51 designates a sheet cassette and 52 designates a pickup roller.

The toner image is fixed by a fixing device 60 and is discharged through a discharge path 70 onto a sheet tray 81 formed on a casing 80 of the apparatus. The image forming apparatus of this example has two separate discharge paths 71, 72 as the discharge path 70. The sheet after the fixing device 60 is discharged through either one of the discharge paths 71, 72. The discharge paths 71, 72 have a switchback path through which a sheet passing through the discharge path 71 or 72 is returned and fed again through a return roller 73 to the second transfer portion T2 in case of forming images on both sides of the sheet.

The actions of the image forming apparatus as a whole will be summarized as follows:

(1) As a printing command (image forming signal) is inputted into a controlling unit 90 of the image forming apparatus from a host computer (personal computer) (not shown) or the like, the photoreceptor 140, the respective rollers 11 of the developing devices 10, and the intermediate transfer belt 36 are driven to rotate.

(2) The outer surface of the photoreceptor 140 is uniformly charged by the charging roller 160.

(3) The outer surface of the photoreceptor 140 is exposed to selective light L1 corresponding to image information for a first color (e.g. yellow) by the exposure unit 40, thereby forming an electrostatic latent image for yellow.

(4) Only the development roller of the developing device 10Y for yellow as the first color is brought in contact with the photoreceptor 140 so as to develop the aforementioned electrostatic latent image, thereby forming a toner image of yellow as the first color on the photoreceptor 140.

(5) The primary transfer voltage of the polarity opposite to the polarity of the toner is applied to the intermediate transfer belt 36, thereby transferring the toner image formed on the photoreceptor 140 onto the intermediate transfer belt 36 at the primary transfer portion T1. At this point, the secondary transfer roller 38 and the belt cleaner 39 are separate from the intermediate transfer belt 36.

(6) After residual toner particles remaining on the photoreceptor 140 is removed by the cleaning means 170, the charge on the photoreceptor 140 is removed by removing light L2 from a removing means 41.

(7) The above processes (2)–(6) are repeated as necessary. That is, according to the printing command, the processes are repeated for the second color, the third color, and the forth color and the toner images corresponding to the printing command are superposed on each other on the intermediate transfer belt 36.

(8) A sheet S is fed from the sheet feeder 50 at a predetermined timing, the toner image (a full color image formed by superposing the four toner colors) on the intermediate transfer belt 36 is transferred onto the sheet S with the second transfer roller 38 immediately before or after an end of the sheet S reaches the secondary transfer portion T2 (namely, at a timing as to transfer the toner image on the intermediate transfer belt 36 onto a desired position of the sheet S). The belt cleaner 39 is brought in contact with the intermediate transfer belt 36 to remove toner particles remaining on the intermediate transfer belt 36 after the secondary transfer.

(9) The sheet S passes through the fixing device 60 whereby the toner image on the sheet S is fixed. After that, the sheet S is carried toward a predetermined position (toward the sheet tray 81 in case of single-side printing, or toward the return roller 73 via the switch-back path 71 or 72 in case of dual-side printing).

Though the image forming apparatus according to the present invention employs such a developing method that the development rollers 11 and the intermediate transfer medium 36 are in contact with the photoreceptor 140, the image forming apparatus according to the present invention may employ a non-contact jumping developing method.

A schematic front view of a full color printer of the tandem type to be used in the present invention is shown in FIG. 4. In this case, the photoreceptor and the developing unit are combined in one unit, that is, can be installed as a process cartridge to the apparatus. Though this example is of a contact development type, the apparatus may be of a non-contact development type.

The image forming apparatus comprises an intermediate transfer belt 30 which is wound onto and tightly held by only two rollers, i.e. a driving roller 10 and a driven roller 20, and is driven to circulate in a direction of arrow (the counter-clockwise direction), and a plurality of (four) single-color toner image forming means 40 (Y, C, M, K) arranged along the intermediate transfer belt 30. Respective toner images formed by the single-color toner image forming means 40 are sequentially primary-transferred to the intermediate transfer belt 30 by transfer means 51, 52, 53, 54, respectively. The respective primary transfer portions are indicated with T1Y, T1C, T1M, and T1K.

As the single-color toner image forming means, there are one 40(Y) for yellow, one 40(M) for magenta, one 40(C) for cyan, and one 40(K) for black. Each of these single-color toner image forming means 40 (Y, C, M, K) comprises a photoreceptor 41 having a photosensitive layer on its outer surface, a charging roller 42 as charging means for uniformly charging the outer surface of the photoreceptor 41, an exposure means 43 for selectively exposing the outer surface of the photoreceptor 41, uniformly charged by the charging roller 42, so as to form an electrostatic latent image, a development roller 44 for developing the electrostatic latent image, formed by the exposure means 43, with developer or toner so as to form a visible image (toner image), and a cleaning blade 45 as cleaning means for removing toner particles remaining on the surface of the photoreceptor after the toner image is transferred to the intermediate transfer belt 30 as the primary transfer medium.

These single-color toner image forming means 40 (Y, C, M, K) are arranged on a loose side of the intermediate transfer belt 30. Toner images are sequentially transferred to the intermediate transfer belt 30 and sequentially superposed on each other on the intermediate transfer belt 30 so as to form a full color toner image. The full color toner image is secondary-transferred to a recording medium P such as a paper at a secondary transfer portion T2 and is fixed by passing the recording medium P between a pair of fixing rollers 61. After that, the recording medium P is discharged by a pair of discharge rollers 62 to a predetermine location (an output sheet tray (not shown)). Numeral 63 designates a sheet cassette for holding recording media P in a piled state, 64 designates a pickup roller for feeding the recording media P one by one from the sheet cassette 63, 65 designates a pair of gate rollers for regulating the feeding timing of the recording medium P from the sheet cassette 63.

Numeral 66 designate a secondary transfer roller as secondary transfer means for cooperating with the intermediate transfer belt 30 to provide the secondary transfer portion T2 therebetween, 67 designates a cleaning blade as cleaning means for removing toner particles remaining on the surface of the intermediate transfer belt 30 after the secondary transfer. The cleaning blade 67 is in contact with the intermediate transfer belt 30 at a wrapping portion on the driving roller 10 not the driven roller 20.

Conventionally, a regulating blade has been used for negatively charging toner. However, since the toner has a particle size distribution, a number of toner particles are not brought in contact with the regulating blade, thus creating a charge distribution in the toner layer adhering to the development roller. This means that the toner is carried to the developing portion with positively charged toner particles contained therein. It is expected that this may cause fog. According to the present invention, however, fog may be prevented even though the toner has a particle size distribution. This is because positively charged toner particles in toner being carried are negatively charged by friction with the photoreceptor when the toner is developed by the contact development with the photoreceptor, whereby development is not carried out on negatively charged non-image portions and is carried out on image portions. As a result of this, a high-quality uniform toner image can be formed on the photoreceptor without fog. In addition, since the developed toner image is negatively charged, the transfer efficiency to a transfer member or a transfer medium is increased. Accordingly, the amount of residual toner particles after transfer can be significantly reduced, thereby reducing the load of the cleaning unit and allowing the use of a smaller toner container of the cleaning unit. Moreover, the consumption of toner can be reduced, thereby reducing the running cost.

Hereinafter, the present invention will be described in detail with reference to specific examples. Product examples of the organic photoreceptor, the toner, the transfer medium, the toner layer regulating blade, and the intermediate transfer medium employed in the specific examples will be explained below.

Product Example of Organic Photoreceptor [OPC (1)]

A conductive supporting body was prepared by grinding the surface of a drawn aluminium pipe of 30 mm in diameter. A coating liquid was prepared by dissolving and dispersing 6 parts by weight of alcohol dissolvable nylon [available from Toray Industries, Inc. (CM8000)] and 4 parts by weight of titanium oxide fine particles treated with aminosilane into 100 parts by weight of methanol. The coating liquid was coated on the peripheral surface of the conductive supporting body by the ring coating method and was dried at a temperature 100° C. for 40 minutes, thereby forming an undercoat layer having a thickness of 1.5 to 2 μm.

A pigment dispersed liquid was prepared by dispersing 1 part by weight of oxytitanyl phthalocyanine pigment as a charge generation pigment, 1 part by weight of butyral resin [BX-1, available from Sekisui Chemical Co., Ltd.], and 100 parts by weight of dichloroethane for 8 hours by a sand mill with glass beads of ϕ1 mm. The pigment dispersed liquid was coated on the undercoat layer and was dried at a temperature of 80° C. for 20 minutes, thereby forming a charge generation layer having a thickness of 0.3 μm.

A liquid was prepared by dissolving 40 parts by weight of charge transport material of a styryl compound having the following structural formula (1) and 60 parts by weight of polycarbonate resin (Panlite TS, available from Teijin Chemicals Ltd.) into 400 parts by weight of toluene. The charge transport material liquid was coated on the charge generation layer by the dip coating to have a thickness of 22 μm when dried, thereby forming a charge transport layer. In this manner, an organic photoreceptor [OPC (1)] of a lamination type was obtained.

Structural Formula (1)

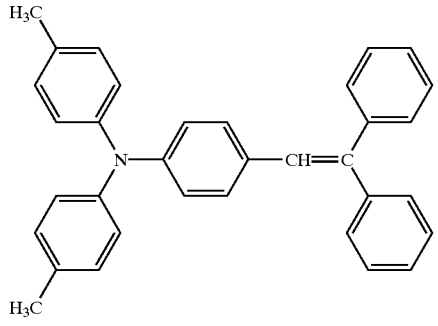

The work function of the obtained organic photoreceptor was 5.48 eV.

An organic photoreceptor [OPC (2)] was obtained in the same manner as the above product example OPC (1) except that an aluminium pipe of 85.5 mm in diameter was used as the conductive supporting body and that a butadiene compound having the following formula (2) was used as the charge transport material. The obtained organic photoreceptor was partially cut for measuring the work function in the same manner. The work function was 5.27 eV.

Structural Formula (2)

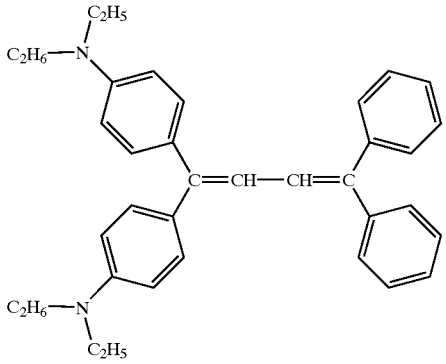

An organic photoreceptor [OPC (3)] was obtained in the same manner as the above OPC (2) except that a nickel electroforming pipe having a seamless thickness 40 μm and a diameter of 85.5 mm. The work function of this organic photoreceptor was 5.26 eV.

Product Example of Organic Photoreceptor [OPC (4)]

An organic photoreceptor [OPC (4)] was obtained in the same manner as the above product example OPC (1) except that a butadiene compound having the above formula (2) was used as the charge transport material. The work function of this organic photoreceptor was 5.27 eV.

Product Example of Organic Photoreceptor [OPC (5)]

An organic photoreceptor [OPC (5)] was obtained in the same manner as the above product example OPC (1) except that a benzidine compound having the following formula (3) was used as the charge transport material. The work function of this organic photoreceptor was 5. 72 eV.

Structural Example (3)

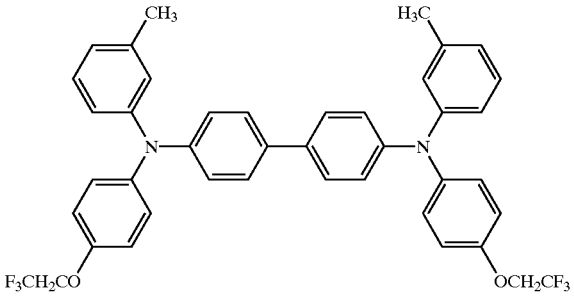

Product Example of Organic Photoreceptor [OPC (6)]

An organic photoreceptor [OPC (6)] was obtained in the same manner as the above product example OPC (3) except that titanyl phthalocyanine pigment was used as the charge generation pigment and that a butadiene compound having the above formula (2) was used as the charge transport material. The work function of this organic photoreceptor was 5.27 eV.

Product Example of Organic Photoreceptor [OPC (7)]

An organic photoreceptor [OPC (7)] was obtained in the same manner as the above product example OPC (3) except that titanyl phthalocyanine pigment was used as the charge generation pigment and that a benzidine compound having the above formula (3) was used as the charge transport material. The work function of this organic photoreceptor was 5.72 eV.

Product Example of Organic Photoreceptor [OPC (8)]

An organic photoreceptor [OPC (8)] was obtained in the same manner as the above product example OPC (2) except that titanyl phthalocyanine pigment was used as the charge generation pigment and that a butadiene compound having the above formula (2) was used as the charge transport material. The work function of this organic photoreceptor was 5.27 eV.

Product Example of Toner (1)

100 parts by weight of a mixture (available from Sanyo Chemical Industries, Ltd.) which was 50:50 (by weight) of polycondensate polyester, composed of aromatic di-carboxylic acid and bisphenol A of alkylene ether, and partially crosslinked compound of the polycondensate polyester by polyvalent metal, 5 parts by weight of phthalocyanine Blue as a cyan pigment, 3 parts by weight of polypropylene having a melting point of 152° C. and a Mw of 4000 as a releasing agent, and 4 parts by weight of metal complex compound of salicylic acid E-81 (available from Orient Chemical Industries, Ltd.) as a charge control agent were uniformly mixed by using a Henschel mixer, kneaded by a twin-shaft extruder with an internal temperature of 150° C., and then cooled. The cooled substance was roughly pulverized into pieces of 2 square mm or less and then pulverized into fine particles by a turbo mill. The fine particles were classified by a rotary classifier, thereby obtaining toner mother particles having a mean particle diameter of 7.5 $\mu$m and a degree of circularity of 0.925.

Subsequently, hydrophobic silica (mean particle diameter: 12 nm, specific surface: 140 $m^2/g$) of which surface was treated by hexamethyldisilazane (HMDS) was added in an amount of 1% by weight to the toner mother particles and titanium oxide (mean particle diameter: 20 nm, specific surface: 90 $m^2/g$) of which surface was treated by silane coupling agent was added in an amount of 0.4% by weight to the toner mother particles. In this manner, a cyan toner (1) was obtained.

The measured work function of this toner was 5.42 eV.

The particle size distribution of this toner (1) was measured by FPIA2100 available from Sysmex corporation. According to the result of the measurement, the toner had a particle size distribution in which particles having a particle diameter of 3 $\mu$m or less occupy 25% based on the number.

A toner (2) was obtained as follows. The same rough pulverized toner particles as made in the process of making the toner (1) were pulverized into fine particles by using a jet mill instead of the turbo mill and were classified by the rotary classifier so as to obtain toner mother particles having a mean particle diameter of 7.6 $\mu$m and a degree of circularity of 0.911. The toner mother particles were surface-treated in the same manner as the toner (1). In this manner, the toner (2) was obtained. The work function of this toner was 5.42 eV.

A toner (3) was obtained as follows. The same toner mother particles as made in the process of making the toner (2) were surface-treated by adding hydrophobic silica (mean particle diameter: 7 nm, specific surface: 250 $m^2/g$) in an amount of 0.2% by weight, after that, were partially spheroidized by using a hot air spheroidizing apparatus Suffusing System SFS-3 (available from Nippon Pneumatic Mfg. Co., Ltd.) at a treatment temperature of 200° C. for improving the circularity, and were classified in the same manner, thereby forming toner mother particles having a mean particle diameter of 7.6 $\mu$m and a degree of circularity of 0.940.

Subsequently, hydrophobic silica (mean particle diameter: 12 nm, specific surface: 140 $m^2/g$) of which surface was treated by hexamethyldisilazane (HMDS) was added in an amount of 1% by weight to the toner mother particles and titanium oxide (mean particle diameter: 20 nm, specific surface: 90 $m^2/g$) of which surface was treated by silane coupling agent was added in an amount of 0.4% by weight to the toner mother particles. In this manner, the toner (3) was obtained. The work function of this toner was 5.43 eV.

Product Example of Toner (4)

Toner mother particles having a mean particle diameter of 7.6 $\mu$m and a degree of circularity of 0.926 were obtained in the same manner as the product example toner (1) except that Quinacridon was used as the pigment.

The obtained toner mother particles were treated to have external additives in the same manner as the toner (1). In this manner, a magenta toner (4) was obtained. The work function of this toner was 5.64 eV. According to the result of measurement of particle size distribution, the toner had a particle size distribution in which particles having a particle diameter of 3 $\mu$m or less occupy 24% based on the number.

Product Example of Toner (5)

A yellow toner (5) was obtained in the same manner as the product example toner (1) except that Pigment Yellow 180 was used as the pigment. The work function of this yellow toner was 5.61 eV. The mean particle diameter and the degree of circularity of this toner were the same as those of the toner (2).

Product Example of Toner (6)

A black toner (6) was obtained in the same manner as the product example toner (1) except that Carbon Black was used as the pigment. The work function of this black toner was 5.71 eV. The mean particle diameter and the degree of circularity of this toner were the same as those of the toner (2).

Product Example of Toner (7)

A monomer mixture composed of 80 parts by weight of styrene monomer, 20 parts by weight of butyl acrylate, and 5 parts by weight of acryl acid was added into a water soluble mixture composed of:

| | |
|---|---|
| water | 105 parts by weight; |
| nonionic emulsifier | 1 part by weight; |
| anion emulsifier | 1.5 parts by weight; and |
| potassium persulfate | 0.55 parts by weight |

and was agitated in nitrogen gas atmosphere at a temperature of 70° C. for 8 hours. By cooling after polymerization reaction, milky white resin emulsion having a particle size of 0.25 $\mu$m was obtained.

Then, a mixture composed of:

| | |
|---|---|
| resin emulsion obtained above | 200 parts by weight; |
| polyethylene wax emulsion (Sanyo Chemical Industries, Ltd.) | 20 parts by weight; and |
| Phthalocyanine Blue | 7 parts by weight |

was dispersed into water containing dodecyl benzene sulfonic acid sodium as a surface active agent in an amount of 0.2 parts by weight, and was adjusted to have pH of 5.5 by adding diethyl amine. After that, electrolyte aluminium sulfate was added in an amount of 0.3 parts by weight with agitation and subsequently agitated at a high speed and thus dispersed by using a TK homo mixer.

Further, 40 parts by weight of styrene monomer, 10 parts by weight of butyl acrylate, and 5 parts by weight of zinc salicylate were added with 40 parts by weight of water, agitated in nitrogen gas atmosphere, and heated at a temperature of 90° C. in the same manner. By adding hydrogen peroxide, polymerization was conducted for 5 hours to grow up particles.

After the polymerization, the pH was adjusted to be 5 or more while the temperature was increased to 95° C. and then maintained for 5 hours in order to improve the bonding strength of associated particles. The obtained particles were washed with water and dried under vacuum at a temperature of 45° C. for 10 hours. In this manner, toner mother particles having a mean particle diameter of 6.8 μm and a degree of circularity of 0.98 were obtained.

Subsequently, hydrophobic silica (mean particle diameter: 12 nm, specific surface: 140 $m^2/g$) of which surface was treated by hexamethyldisilazane (HMDS) was added in an amount of 1% by weight to the toner mother particles and titanium oxide (mean particle diameter: 20 nm, specific surface: 90 $m^2/g$) of which surface was treated by silane coupling agent was added in an amount of 0.8% by weight to the toner mother particles. In this manner, a cyan toner (7) was obtained. The work function of this toner was 5.65 eV.

According to the result of measurement of particle size distribution, this toner had a particle size distribution in which particles having a particle diameter of 3 μm or less occupy 11% based on the number.

Product Example of Toner (8)

A magenta toner (8) was obtained in the same manner as the product example toner (7) except that Quinacridon was used as the pigment and that the temperature for improving the association and the film bonding strength of secondary particles was still 90° C. This toner have a mean particle diameter of 6.9 μm, a degree of circularity of 0.97, and a work function of 5.56 eV.

According to the result of measurement of particle size distribution, (his toner had a particle size distribution in which particles having a particle diameter of 3 μm or less occupy 10% based on the number.

Product Example of Development Roller (1)

A tube of conductive silicone rubber (JIS-A hardness: 63 degrees, volume resistivity in sheet: $3.5\times10^6$ Ω cm) was bonded to the outer surface of an aluminium pipe of 18 mm in diameter to have a thickness of 2 mm after grinding. The surface roughness (Ra) was 5 μm and the work function was 5.08 eV.

Product Example of Development Roller (2)

An aluminium pipe of 18 mm in diameter was surfaced with nickel plating (thickness: 23 μm). The surface roughness (Ra) was 4 μm. The result of measurement, the work function of the surface of this development roller was 4.58 eV.

Product Example of Regulating Blade

Conductive polyurethane rubber tips of 1.5 mm in thickness were attached to a SUS plate of 80 μm in thickness by conductive adhesive. The work function of the polyurethane rubber surface was 5.0 eV.

Product Example of Intermediate Transfer Medium (1)

A uniformly dispersed liquid composed of:

| | |
|---|---|
| vinyl chloride-vinyl acetate copolymer | 30 parts by weight; |
| conductive carbon black | 10 parts by weight; and |
| methyl alcohol | 70 parts by weight |

was coated on a polyethylene terephthalate resin film of 130 μm in thickness with aluminium deposited thereon by the roll coating method to have a thickness of 20 μm and dried to form an intermediate conductive layer.

Then, a coating liquid made by mixing and dispersing the following components:

| | |
|---|---|
| nonionic aqueous polyurethane resin (solid ratio: 62 wt. %) | 55 parts by weight; |
| polytetrafluoroethylene emulsion resin(solid ratio: 60 wt. %) | 11.6 parts by weight |
| conductive tin oxide | 25 parts by weight; |
| polytetrafluoroethylene fine particles (max particle diameter: 0.3 μm or less) | 34 parts by weight; |
| polyethylene emulsion (solid ratio: 35 wt. %) | 5 parts by weight; and |
| deionized water | 20 parts by weight; |

was coated on the intermediate conductive layer by the roll coating method to have a thickness of 10 μm and dried in the same manner so as to form a transfer layer.

The obtained coated sheet was cut to have a length of 540 mm. The ends of the cut piece are superposed on each other with the coated surface outward and welded by ultrasonic, thereby making an intermediate transfer medium (transfer belt). The volume resistivity of this transfer belt was $2.5\times10^{10}$ Ω cm. The work function was 5.37 eV and the normalization photoelectron yield was 6.90.

Product Example of Intermediate Transfer Medium (2)

A transfer belt was made in the same manner as the production example intermediate transfer medium (1) except that 5 parts by weight of conductive titanium oxide and 25 parts by weight of conductive tin oxide were used instead of 25 parts by weight of conductive tin oxide as one component for the transfer layer. The volume resistivity of this transfer belt was $8.8\times10^9$ Ω cm. The work function was 5.69 eV and the normalization photoelectron yield was 7.39.

Product Example of Intermediate Transfer Medium (3)

85 parts by weight of polyethylene terephthalate, 15 parts by weight of polycarbonate, and 15 parts by weight of acetylene black were previously mixed in atmosphere of nitrogen gas by a mixer. The obtained mixture was kneaded also in atmosphere of nitrogen gas by a twin-shaft extruder to have a pellet.

The pellet was extruded by a single shaft extruder with an annular die into a tubular film having an outer diameter of 160 mm and a thickness of 160 μm at a temperature of 260° C. Then, the hot tube obtained by the extrusion was set to fix its inner diameter by a cool inside mandrel supported coaxially with the annular die. By cooling and solidifying the tube in this state, a seamless tube was made.

The seamless tube was cut into a predetermined size, thereby obtaining a seamless transfer belt having an outer diameter of 172 mm, a width of 383 mm, and a thickness of 150 μm. The volume resistivity of this transfer belt was $3.2\times10^8$ Ω cm. The work function was 5.19 eV and the normalization photoelectron yield was 10.88.

EXAMPLE 1

The toner (1), the toner (4), and the organic photoreceptors [OPC (1), OPC (4), OPC (5)] obtained above were employed to have combinations as shown in Table 1 and adopted to the apparatus of contact single-component developing method shown in FIG. 1.

For tests, the peripheral velocity of the organic photoreceptor was set to 180 mm/s. The development roller (1) obtained above was employed and the peripheral velocity thereof was set to have a specific ratio of 2 relative to the organic photoreceptor The development roller was pressed against the organic photoreceptor at pressing load 40 gf/cm with a nip width of 1.5 mm.

A toner regulating blade was made by bending the end of a SUS plate of 80 μm in thickness by 10° to have projection length of 0.6 mm. The work function was 5.01 eV. The toner regulating blade was arranged to be pressed against the development roller with a linear load of 33 gf/cm in such a manner as to make the toner layer on the development roller into a uniform thickness of 15 μm and to regulate such that the number of layers made up of toner particles becomes 2.

The dark potential of the photoreceptor was set to −600 V, the light potential thereof was set to −100 V, and the developing bias was set to −200 V. The development roller and the supply roller were set to have the same potential.

The intermediate transfer belt (1) obtained above was employed as the transfer medium. The intermediate transfer belt was pressed against the organic photoreceptor by the transfer roller with a pressing load 15 gf/cm and a nip width of 3 mm. A voltage of +300 V was applied to the transfer roller and a voltage of +800 V was applied to a secondary transfer roller (not shown). The pressing load onto the secondary transfer roller was set to 35 gf/cm.

White solid image of A4 size was repeatedly printed on 1000 sheets of paper. After printing 1000 sheets of paper, the amount of fog toner, to be scrapped by the cleaning unit, on the organic photoreceptor was measured by measuring the weight of the cleaning unit. The result is shown in Table 1.

Solid image of 10 mm in width was printed under the same condition. The amount of toner ($W_1$) developed on the photoreceptor and the amount of toner ($W_2$) remaining on the photoreceptor after transfer are measured by the tape transfer method. Based on the amounts of toner, the transfer efficiency ($W_1-W_2/W_1$) was calculated. The result is also shown in Table 1.

It should be noted that the tape transfer method is a method comprising attaching a tape onto toner, measuring a difference between the weight of the tape before and after the attachment, and calculating the amount of toner (mg/cm$^2$).

Figure 5:
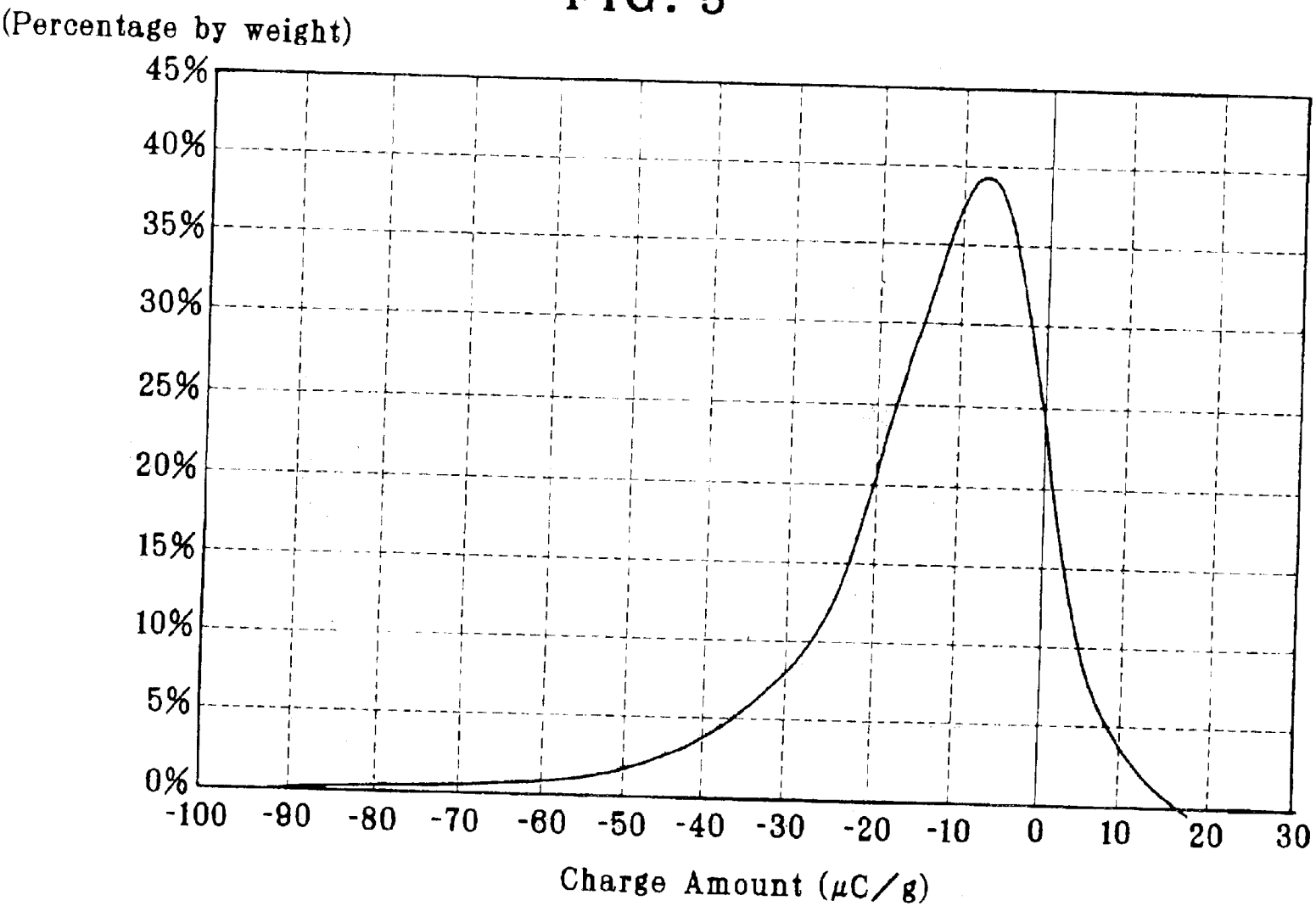
FIG. 5 is a diagram showing a charge distribution characteristic of toner particles used in the image forming apparatus of the present invention.

The charge distribution characteristic of a layer of the toner (4) adhering to the surface of the development roller after passing through the toner regulating blade was measured by a tester E-SPART III available from Hosokawa Micron Corporation. The result is shown in FIG. 5. FIG. 5 plots percentage by weight as the abscissa and charge amount (μc/g) as the ordinate. As apparent from the graph, negatively charged toner particles occupies 91.4% and positively charged toner particles occupies 8.6% after passing the toner regulating blade.

TABLE 1

| Combination Case | Toner and its work function | Organic photoreceptor and its work function | Amount of fog toner (g/1000 sheets) | Transfer efficiency (%) |
|---|---|---|---|---|
| 1 | Toner (1) | OPC (1) 5.48 eV | 7.05 | 92.0 |
| 2 | 5.42 eV | OPC (4) 5.27 eV | 4.43 | 95.1 |
| 3 | | OPC (5) 5.72 eV | 10.98 | 90.4 |
| 4 | Toner (4) | OPC (1) 5.48 eV | 3.02 | 95.3 |
| 5 | 5.64 eV | OPC (4) 5.27 eV | 2.51 | 96.0 |
| 6 | | OPC (5) 5.72 eV | 10.50 | 91.9 |

As apparent from Table 1, by setting the work function of toner to be larger than the work function of the organic photoreceptor just like the combination cases 2, 4, 5, the amount of fog toner can be reduced so as to obtain improved transfer efficiency as compared to the combination cases 1, 3, 6 in which the work function of toner is set to be smaller than the work function of the organic photoreceptor.

The toner (7) obtained above was also combined with the OPC (1), the OPC (4), and the OPC (5) and printed images in the same manner as mentioned above. Though the results were nearly equal to the results of the above combination cases 4 through 6, a combination with the OPC (1) exhibited transfer efficiency higher than the case of using the toner (4), i.e. 98.3%.

The toner (8) obtained above was also combined with the OPC (1), the OPC (4), and the OPC (5), respectively, and printed images in the same manner as mentioned above. Combinations with the OPC (1), the OPC (4) exhibited excellent efficiency of reducing the amount of fog toner. A combination with the OPC (1) exhibited transfer efficiency higher than the case of using the toner (1), i.e. 98.5%.

It should be noted that since the work function of the OPC (5) obtained above was 5.72 eV which is higher than the work function of any of the toner (1), the toner (4), the toner (7), and the toner (8), any case using the OPC (5) did not exhibit efficiency of the present invention.

EXAMPLE 2

The toner (1), the toner (4), and the organic photoreceptors [OPC (1), OPC (4), OPC (5)] obtained above were employed to have combinations as shown in Table 2 and adopted to the apparatus of non-contact single-component developing method shown in FIG. 2.

For tests, the peripheral velocity of the organic photoreceptor was set to 180 mm/s. The development roller (1) was employed and the peripheral velocity thereof was set to have a specific ratio of 2 relative to the organic photoreceptor. A development gap L was set to 210 μm (the space was adjusted by a gap roller). A developing bias was applied under condition that an alternating current (AC) to be superimposed on a direct current (DC) of −200 V was set to have a frequency of 2.5 kHz, and P-P voltage was set to 1500 V.

Similarly to Example 1, a regulating blade made of a SUS plate of 80 μm in thickness was used as the toner regulating blade. The toner regulating blade was arranged to be pressed against the development roller with a pressure load of 28 gf/cm in such a manner as to make the toner layer on the development roller into a uniform thickness of 18 μm and to regulate such that the number of layers made up of toner particles becomes 2.5.

The dark potential of the photoreceptor was set to −600 V, the light potential thereof was set to −100 V, and the developing bias was set to −200 V. The development roller and the supply roller were set to have the same potential.

The intermediate transfer belt (1) obtained above was employed as the transfer medium. The intermediate transfer belt was pressed against the organic photoreceptor by the transfer roller with a pressing load 21 gf/cm and a nip width of 3 mm. A voltage of +300 V was applied to the transfer roller and a voltage of +800 V was applied to a secondary transfer roller (not shown). The pressing load onto the secondary transfer roller was set to 35 gf/cm.

White solid image of A4 size was repeatedly printed on 1000 sheets of paper. After printing 1000 sheets of paper, the amount of fog toner was measured and the transfer efficiency was calculated in the same manner as Example 1. The results are shown in Table 2.

TABLE 2

| Combination Case | Toner and its work function | Organic photoreceptor and its work function | Amount of fog toner (g/1000 sheets) | Transfer efficiency (%) |
|---|---|---|---|---|
| 7 | Toner (1) | OPC (1) 5.48 eV | 7.00 | 91.9 |
| 8 | 5.42 eV | OPC (4) 5.27 eV | 5.86 | 94.0 |
| 9 | | OPC (5) 5.72 eV | 9.35 | 90.0 |
| 10 | Toner (4) | OPC (1) 5.48 eV | 7.05 | 94.1 |
| 11 | 5.64 eV | OPC (4) 5.27 eV | 6.02 | 94.9 |
| 12 | | OPC (5) 5.72 eV | 8.93 | 90.4 |

As apparent from Table 2, by setting the work function of toner to be larger than the work function of the organic photoreceptor just like the combination cases 8, 10, 11, the amount of fog toner can be reduced so as to obtain improved transfer efficiency as compared to the cases in which the work function of toner is set to be smaller than the work function of the organic photoreceptor just like the combination cases 7, 9, 12.

EXAMPLE 3

The toners for four colors: the cyan toner (1); the magenta toner (4); the yellow toner (5); and the black toner (6), and the organic photoreceptor [OPC (4)] obtained above were combined to form full-color images. As an image forming apparatus, a four-cycle color printer of the non-contact developing type as shown in FIG. 3 (in this case, however, the aluminium pipe of the organic photoreceptor [OPC (4)] was 85.5 mm in diameter) was assembled. In addition, a tandem color printer of the contact developing type as shown in FIG. 4 (in this case, however, the aluminium pipe of the organic photoreceptor [OPC (4)] was 40 mm in diameter) was assembled.

Either printer can provide uniform full-color images. After character image corresponding to color original containing 5% each color was continuously printed on 10000 sheets of paper, the total amount of four color toners collected by cleaning the photoreceptor was measured. In case of the four cycle type color printer shown in FIG. 3, the measured amount was 120 g. In case of the tandem type color printer shown in FIG. 4, the measured amount was 135 g. Evaluation was given that these amounts were about ½ of the expected amounts of toners collected by cleaning the photoreceptor.

EXAMPLE 4

As the organic photoreceptor, the OPC (3) obtained above as an elastic photoreceptor was used. The development roller (2) obtained above was used as the development roller, and the regulating blade obtained in the aforementioned product example with polyurethane tips thereon was used as the regulating blade. As the intermediate transfer belt, either the intermediate transfer belt (1) or the intermediate transfer belt (2) obtained above was used. The toner (1) through the toner (3) were employed. The above elements were combined as shown in Table 3 so that a four-cycle color printer of the intermediate transfer medium type shown in FIG. 3 was assembled as a printer of contact mono-component developing type.

For tests, the peripheral velocity of the organic photoreceptor was set to 180 mm/s. The peripheral velocity of the development roller was set to have a specific ratio of 2 relative to the organic photoreceptor. The development roller was pressed against the organic photoreceptor by a pressing load of 40 gf/cm and with a nip width of 1.5 mm. The dark potential of the photoreceptor was set to −600 V, the light potential thereof was set to −100 V, and the developing bias was set to −200 V. The development roller and the supply roller were set to have the same potential.

The toner regulating blade was arranged to be pressed against the development roller with a linear load of 32 gf/cm in such a manner as to make the toner layer on the development roller into a uniform thickness of 16 $\mu$m and to regulate such that the number of layers made up of toner particles becomes 2.1. The toner carrying amount was about 0.53 mg/cm$^2$.

The difference in peripheral velocity between the organic photoreceptor and the transfer belt is set such that the transfer belt is faster than the organic photoreceptor by 3%. When exceeding 3%, flush was appeared on transfer images in pretests. Therefore, the upper limit was set 3%. The transfer belt was pressed against the organic photoreceptor by a backup roller with a pressing load 15 gf/cm and a nip width of 3 mm. A voltage of +300 V was applied to the primary transfer roller as the backup roller and a voltage of +800 V was applied to a secondary transfer roller. The pressing load onto the secondary transfer roller was set to 35 gf/cm.

The full color printer of FIG. 3 was set to be used as a mono-color printer for tests by filling a cyan developing unit thereof with any one of the toner (1), the toner (2), and the toner (3). In this state, white solid image of A4 size was repeatedly printed on 1000 sheets of paper.

After printing 1000 sheets of paper, the amount of fog toner, to be scrapped by the cleaning unit, on the organic photoreceptor was measured by measuring the weight of the cleaning unit. The result is shown in Table 3.

Solid image of 10 mm in width was printed under the same condition, The amount of toner ($W_1$) developed on the photoreceptor and the amount of toner ($W_2$) remaining on the photoreceptor after transfer are measured by the tape transfer method. Based on the measurement, the transfer efficiency ($W_1-W_2/W_1$) was calculated. The result is also shown in Table 3.

TABLE 3

| Combination Case | Toner and its work function | Degree of circularity | Intermediate transfer belt and its work function | Amount of fog toner (g/1000 sheets) | Transfer efficiency (%) |
|---|---|---|---|---|---|
| 13 | Toner (1) 5.42 eV | 0.925 | Intermediate transfer belt (1) 5.37 eV | 7.01 | 97.4 |
| 14 | Toner (2) 5.42 eV | 0.911 | | 7.10 | 96.8 |
| 15 | Toner (3) 5.43 eV | 0.940 | | 6.37 | 98.6 |
| 16 | Toner (1) 5.42 eV | 0.925 | Intermediate transfer belt (2) 5.69 eV | 9.88 | 95.1 |
| 17 | Toner (2) 5.42 eV | 0.911 | | 10.13 | 92.5 |
| 18 | Toner (3) 5.43 eV | 0.940 | | 7.99 | 96.3 |

As apparent from Table 3, by setting the work function of the intermediate transfer belt to be smaller than the work function of the toner just like the combination cases 13–15, the amount of fog toner can be reduced so as to obtain improved transfer efficiency. It can be also found that, by increasing the degree of circularity, the amount of fog toner can be reduced and also the transfer efficiency can be increased in the order of the combination cases 14, 13, 15.

The charge distribution characteristic of a layer of the toner (2) adhering to the surface of the development roller after passing through the toner regulating blade was measured by using a tester E-SPART III available from Hosokawa Micron Corporation. The result is shown in FIG. 6. FIG. 6 plots percentage by weight as the abscissa and charge amount ($\mu$c/g) as the ordinate.

In this graph, a solid line without any mark indicates a case of using the toner (2) of the present invention. It shows that positively charged toner particles occupies about 10%. A solid line with mark Δ indicates a case that the toner (2) is excessively charged by pressing the toner regulating blade against the development roller by a linear load about 70 gf/cm. A solid line with mark x indicates a case that the toner (2) is insufficiently charged by pressing the toner regulating blade against the development roller by a linear load abut 10 gf/cm. It can be found that, in either case, positively charge toner particles exist in negatively charged toner.

EXAMPLE 5

As the organic photoreceptor, the OPC (2) obtained above as a hard photoreceptor was used. The development roller (2) obtained above was used as the development roller, the intermediate transfer belt (1) obtained above was used as the intermediate transfer belt. As the toner, the toner (1) and the toners (4)–(6) obtained above were employed. The four-cycle full color printer of the intermediate transfer type of FIG. 3 was set for image forming tests by filling the color developing units thereof with the toner (1) and the toners (4)–(6) as four color toners, respectively to form images in the non-contact mono-component developing method. The conditions for forming images were the same as those of Example 2.

After character image corresponding to color original containing 5% each color was continuously printed on 10000 sheets of paper, the total amount of four color toners collected by cleaning the photoreceptor was 110 g. This means that the cleaning toner amount can be reduced to about ½ of the expected amounts of toners collected by cleaning the photoreceptor.

EXAMPLE 6

As the organic photoreceptor, the OPC (6) obtained above as an elastic photoreceptor was used. The development roller (2) obtained above and the regulating blade obtained in the aforementioned product example with the polyurethane tip thereon were used. As the intermediate transfer belt, either the intermediate transfer belt (2) or the intermediate transfer belt (3) obtained above was used. With toners shown as follows and the combination as shown in Table 4, a four-cycle color printer of the intermediate transfer medium type shown in FIG. 3 was assembled as a printer of the contact mono-component developing type.

For tests, the peripheral velocity of the organic photoreceptor was set to 180 mm/s. The peripheral velocity of the development roller was set to have a specific ratio of 2 relative to the organic photoreceptor. The development roller was pressed against the organic photoreceptor by a pressing load of 40 gf/em and with a nip width of 1.5 mm. The dark potential of the photoreceptor was set to −600 V, the light potential thereof was set to −100 V, and the developing bias was set to −200 V. The development roller and the supply roller were set to have the same potential.

The toner regulating blade was arranged to be pressed against the development roller with a linear load of 32 gf/cm in such a manner as to make the toner layer on the development roller into a uniform thickness of 16 $\mu$m and to regulate such that the number of layers made up of toner particles becomes 2.1. The toner carrying amount was about 0.53 mg/cm$^2$.

The difference in peripheral velocity between the organic photoreceptor and the transfer belt is set such that the transfer belt is faster than the organic photoreceptor by 3%. When exceeding 3%, flush was appeared on transfer images in pretests. Therefore, the upper limit was set 3%. The transfer belt was pressed against the organic photoreceptor by a backup roller with a pressing load 15 gf/cm and a nip width of 3 mm. A voltage of +300 V was applied to the primary transfer roller as the backup roller and a voltage of +800 V was applied to a secondary transfer roller. The pressing load onto the secondary transfer roller was set to 35 gf/cm.

The full color printer of FIG. 3 was set for tests by filling a cyan developing unit thereof with any one of the toner (1), the toner (2), and the toner (3) and was used to form images in the same manner.

After printing 1000 sheets of paper, the amount of fog toner, to be scrapped by the cleaning unit, on the photoreceptor was measured by measuring the weight of the cleaning unit. The result is shown in Table 5.

Solid image of 10 mm in width was printed under the same condition. The amount of toner ($W_1$) developed on the photoreceptor and the amount of toner ($W_2$) remaining on the photoreceptor after transfer are measured by the tape transfer method. Based on the measurement, the transfer efficiency ($W_1$–$W_2$/$W_1$) was calculated. The result is also shown in Table 5.

It should be noted that a case using the organic photoreceptor [OPC (7)] is shown together.

TABLE 4

| Combination Case | Toner and its work function | Degree of circularity | Organic photoreceptor and its work function | Intermediate transfer belt and its work function |
|---|---|---|---|---|
| 19 | Toner (1) 5.42 eV | 0.925 | OPC (6) | Intermediate |
| 20 | Toner (2) 5.42 eV | 0.911 | 5.27 eV | transfer belt (3) |
| 21 | Toner (3) 5.43 eV | 0.940 | | 5.19 eV |
| 22 | Toner (1) 5.42 eV | 0.925 | OPC (7) | Intermediate |
| 23 | Toner (2) 5.42 eV | 0.911 | 5.72 eV | transfer belt (2) |
| 24 | Toner (3) 5.43 eV | 0.940 | | 5.69 eV |

TABLE 5

| Combination Case | Amount of fog toner (g/1000 sheets) | Transfer efficiency (%) |
|---|---|---|
| 19 | 4.40 | 97.7 |
| 20 | 4.52 | 96.8 |
| 21 | 3.95 | 98.8 |
| 22 | 9.28 | 92.1 |
| 23 | 10.13 | 91.9 |
| 24 | 7.99 | 93.3 |

As apparent from Tables 4 and 5, the combination cases 19–21 satisfying the relation $\Phi_t > \Phi_{OPC} > \Phi_{TM}$ create a reduced amount of fog toner and can exhibit excellent transfer efficiency. It can be also found that as the degree of circularity is increased, the amount of fog toner is reduced and the transfer efficiency is improved in order of the combination cases 20, 19, 21. On the other hand, the combination cases 22–24 create a great amount of fog toner and exhibit poor transfer efficiency.

In addition, a combination of the toner (3), the OPC (6), and the transfer belt (2) and a combination of the toner (3), the OPC (7), and the transfer belt (3) were made and the same printing tests were conducted twice in the same manner. In either combination, the amount of fog toner was in a range of 6 g/1000 sheets to 7 g/1000 sheets or more and the transfer efficiency was 96.8% or less.

EXAMPLE 7

The OPC (7) obtained above as a hard photoreceptor was used as the organic photoreceptor and the development roller (2) obtained above was used as the development roller. A development gap between the development roller and the photoreceptor was set to 210 $\mu$m (the space was adjusted by a gap roller). As the intermediate transfer belt, the intermediate transfer belt (3) obtained above was used. As the toner, the toner (1) and the toners (4)–(6) obtained above were employed. The four-cycle full color printer of the intermediate transfer type of FIG. 3 was set for image forming tests by filling the color developing units thereof with the toner (1) and the toners (4)–(6) as four color toners, respectively to form images in the non-contact mono-component developing method. A developing bias was applied under condition that an alternating current (AC) to be superimposed on a direct current (DC) of −200 V was set to have a frequency of 2.5 kHz, and P-P voltage was set to 1500 V.

After character image corresponding to color original containing 5% each color was continuously printed on 10000 sheets of paper, the total amount of four color toners collected by cleaning the photoreceptor was 105 g. This means that the cleaning toner amount can be reduced to about ½ of the expected amounts of toners collected by cleaning the photoreceptor.

What we claim is:

1. An image forming apparatus comprising: a latent image carrier; and a developing means for charging a toner into a negative polarity by triboelectric charging, for converting an electrostatic latent image on said latent image carrier to a visible image with said toner and transferring said visible image to an intermediate transfer medium, wherein the work function ($\Phi_t$) of said toner is set to be larger than the work function ($\Phi_{TM}$) of the surface of said intermediate transfer medium.

2. An image forming apparatus as claimed in claim 1, wherein the work function ($\Phi_t$) of said toner is in a range from 5.4 to 5.9 eV, the work function ($\Phi_{TM}$) of the surface of said intermediate transfer medium is in a range from 4.9 to 5.5 eV, and the difference between the work function ($\Phi_t$) of said toner and the work function ($\Phi_{TM}$) of the surface of said intermediate transfer medium is at least 0.2 eV or more.

3. An image forming apparatus comprising: a latent image carrier; and a developing means for charging a toner into a negative polarity by triboelectric charging, for converting an electrostatic latent image on said latent image carrier to a visible image with said toner and transferring said visible image to an intermediate transfer medium, wherein the work function ($\Phi_{OPC}$) of the surface of said latent image carrier, the work function ($\Phi_t$) of said toner, and the work function ($\Phi_{TM}$) of the surface of said intermediate transfer medium are set to satisfy a relation $\Phi_t > \Phi_{OPC} > \Phi_{TM}$.

4. An image forming apparatus as claimed in claim 3, wherein the work function ($\Phi_t$) of said toner is in a range from 5.4 to 5.9 eV, the work function ($\Phi_{OPC}$) of the surface of said latent image carrier is in a range from 5.2 to 5.6 eV, and the work function ($\Phi_{TM}$) of the surface of said intermediate transfer medium is in a range from 4.9 to 5.5 eV, and the difference between each pair of them is at least 0.2 eV or more.

5. An image forming apparatus as claimed in claim 1, wherein the number mean particle diameter is from 4 to 10 $\mu$m.

6. An image forming apparatus as claimed in claim 5, wherein the degree of circularity is 0.91 or more.

7. An image forming apparatus as claimed in claim 1, wherein said latent image carrier is an organic photoreceptor to be negatively charged so as to carry out the reversal developing.

8. An image forming apparatus as claimed in claim 1, wherein said latent image carrier and said developing means are rotatably supported to a body of the image forming apparatus such that the latent image carrier and said developing means are in contact with each other, and wherein the peripheral velocity of said developing means is set to be 1.2 to 2.5 times as high as the peripheral velocity of said latent image carrier.

9. An image forming apparatus as claimed in claim 1, wherein said latent image carrier and said developing means are rotatably supported to a body of the image forming apparatus such that said latent image carrier and said developing means are in non-contact with each other, and wherein the pressing load of the intermediate transfer medium against said latent image carrier is set in a range from 20 gf/cm to 60 gf/cm.

10. An image forming apparatus as claimed in claim 1, wherein said developing means comprises a development roller and a toner layer regulating member to regulate such that the number of layers made up of toner particles becomes 1.2 to 3.

11. An image forming apparatus as claimed in claim 1, wherein said image forming apparatus is a full-color image forming apparatus.

12. An image forming apparatus as claimed in claim 1, wherein said latent image carrier and the developing means are unified in a process cartridge to be detachably installed in the image forming apparatus.

13. An image forming apparatus as claimed in claim 1, wherein said peripheral velocity of the intermediate transfer medium is set to be 0.95 to 1.05 times as high as the peripheral velocity of the latent image carrier.

14. An image forming apparatus as claimed in claim 1, wherein said intermediate transfer medium is of a belt type.

15. An image forming apparatus as claimed in claim 3, wherein the number mean particle diameter is from 4 to 10 $\mu$m.

16. An image forming apparatus as claimed in claim 15, wherein the degree of circularity is 0.91 or more.

17. An image forming apparatus as claimed in claim 3, wherein said latent image carrier is an organic photoreceptor to be negatively charged so as to carry out the reversal developing.

18. An image forming apparatus as claimed in claim 3, wherein said latent image carrier and said developing means are rotatably supported to a body of the image forming apparatus such that the latent image carrier and said developing means are in contact with each other, and wherein the peripheral velocity of said developing means is set to be 1.2 to 2.5 times as high as the peripheral velocity of said latent image carrier.

19. An image forming apparatus as claimed in claim 3, wherein said latent image carrier and said developing means are rotatably supported to a body of the image forming apparatus such that said latent image carrier and said developing means are in non-contact with each other, and wherein the pressing load of the intermediate transfer medium against said latent image carrier is set in a range from 20 gf/cm to 60 gf/cm.

20. An image forming apparatus as claimed in claim 3, wherein said developing means comprises a development roller and a toner layer regulating member to regulate such that the number of layers made up of toner particles becomes 1.2 to 3.

21. An image forming apparatus as claimed in claim 3, wherein said image forming apparatus is a full-color image forming apparatus.

22. An image forming apparatus as claimed in claim 3, wherein said latent image carrier and the developing means are unified in a process cartridge to be detachably installed in the image forming apparatus.

23. An image forming apparatus as claimed in claim 3, wherein said peripheral velocity of the intermediate transfer medium is set to be 0.95 to 1.05 times as high as the peripheral velocity of the latent image carrier.

24. An image forming apparatus as claimed in claim 3, wherein said intermediate transfer medium is of a belt type.

* * * * *